US009533819B2

(12) United States Patent
Konno et al.

(10) Patent No.: US 9,533,819 B2
(45) Date of Patent: Jan. 3, 2017

(54) DOUBLE-AEROSOL DEVICE

(71) Applicant: Hoyu Co., Ltd, Nagoya-shi, Aichi (JP)

(72) Inventors: Yoshihiro Konno, Nagakute (JP); Takeshi Komoda, Nagakute (JP); Kazuma Ozawa, Nagakute (JP)

(73) Assignee: Hoyu Co., Ltd., Nagoya-shi, Aichi (JP)

( * ) Notice: Subject to any disclaimer, the term of this patent is extended or adjusted under 35 U.S.C. 154(b) by 3 days.

(21) Appl. No.: 14/410,414

(22) PCT Filed: Jun. 20, 2013

(86) PCT No.: PCT/JP2013/066955

§ 371 (c)(1),
(2) Date: Feb. 17, 2015

(87) PCT Pub. No.: WO2013/191248

PCT Pub. Date: Dec. 27, 2013

(65) Prior Publication Data

US 2015/0175341 A1 Jun. 25, 2015

(30) Foreign Application Priority Data

Jun. 22, 2012 (JP) ..... 2012-141093

(51) Int. Cl.
*B65D 83/62* (2006.01)
*B65D 83/32* (2006.01)
(Continued)

(52) U.S. Cl.
CPC ..... *B65D 83/62* (2013.01); *A45D 19/02* (2013.01); *B65D 83/32* (2013.01); *B65D 83/68* (2013.01);
(Continued)

(58) Field of Classification Search
USPC ..... 222/464.1, 402.1, 94, 394, 189.1, 211, 222/382
See application file for complete search history.

(56) References Cited

U.S. PATENT DOCUMENTS 3,236,418 A * 2/1966 Dalle ..... B65D 83/682 222/131
3,521,792 A * 7/1970 Davidson ..... B65D 83/68 222/136
(Continued)

FOREIGN PATENT DOCUMENTS

CN 101830320 A 9/2010
CN 103097262 A 5/2013
(Continued)

OTHER PUBLICATIONS

Taiwanese Office Action for Application No. 102121882 dated Jul. 6, 2015.
(Continued)

*Primary Examiner* — Donnell Long
(74) *Attorney, Agent, or Firm* — Jenkins, Wilson, Taylor & Hunt, P.A.

(57) ABSTRACT

A double-aerosol device including: inner containers that separately store a plurality of types of hair treatment compositions used by mixing as hair dye, a decoloring agent, or dye remover; and an outer container in which a plurality of inner containers are stored; in which the hair treatment compositions are discharged to the outside by contracting the inner containers by a pressure of propellant, the outer container is configured such that at least a part of the inside of the outer container is visible so as to confirm remaining amounts of the hair treatment compositions, and the inner containers store the hair treatment compositions in pouches.

10 Claims, 19 Drawing Sheets

(51) Int. Cl.

| | |
|---|---|
| ***B65D 83/68*** | (2006.01) |
| ***A45D 19/02*** | (2006.01) |
| *B65D 83/38* | (2006.01) |

(52) U.S. Cl.

CPC ..... *B65D 83/682* (2013.01); *A45D 2200/053* (2013.01); *A45D 2200/057* (2013.01); *A45D 2200/058* (2013.01); *B65D 83/38* (2013.01)

(56) References Cited

U.S. PATENT DOCUMENTS

| | | | | |
|---|---|---|---|---|
| 3,608,782 | A * | 9/1971 | Sathicq | A45D 19/02 222/129 |
| 3,709,437 | A * | 1/1973 | Wright | B05B 7/0037 222/190 |
| 5,411,176 | A * | 5/1995 | Favre | B05B 11/0005 222/137 |
| 5,634,571 | A * | 6/1997 | Cataneo | B05B 12/1418 222/134 |
| 5,848,730 | A | 12/1998 | Kawase et al. | |
| 7,036,685 | B1 * | 5/2006 | Green | B65D 83/303 222/145.6 |
| 7,967,220 | B2 | 6/2011 | Hansen et al. | |
| 9,180,476 | B2 * | 11/2015 | Werner | B05B 11/3083 |
| 2007/0241133 | A1 | 10/2007 | Smith et al. | |
| 2009/0216183 | A1 * | 8/2009 | Minotti | A61M 15/08 604/82 |
| 2013/0284759 | A1 * | 10/2013 | Teramoto | B65D 83/384 222/94 |

FOREIGN PATENT DOCUMENTS

| | | | |
|---|---|---|---|
| CN | 103189283 | | 7/2013 |
| JP | H09/207952 | A | 8/1997 |
| JP | 2000/327053 | A | 11/2000 |
| JP | 2001/122364 | A | 5/2001 |
| JP | 2013/082478 | A | 5/2013 |
| KR | 10-2013-0036334 | A | 4/2013 |
| WO | WO-2012/057342 | A1 | 5/2012 |
| WO | WO-2012/073361 | A1 | 5/2012 |

OTHER PUBLICATIONS

Korean Office Action for Application No. 10 2014 7033847 dated Oct. 10, 2015.

Taiwanese Office Action for Application No. 102121882 dated Mar. 10, 2015.

International Preliminary Report on Patentability for Application No. PCT/JP 2013/066955 dated Dec. 23, 2014.

Written Opinion of the International Searching Authority for Application No. PCT/JP 2013/066955 dated Sep. 24, 2013.

Notification of Transmittal of Translation of the International Preliminary Report on Patentability for Application No. PCT/JP 2013/066955 dated Dec. 31, 2014.

International Search Report for Application No. PCT/JP 2013/066955 dated Sep. 12, 2013.

Extended European Search Report for Application No. 13807225.1 dated Feb. 2, 2016.

Chinese Office Action for Application No. 201380032670.5 dated Jan. 28, 2016.

* cited by examiner

FIG. 16

| THICKNESS T | GAP D | T/D | EVALUATION |
|---|---|---|---|
| 2.3 | 2.5 | 0.92 | PERMISSIBLE |
| 2.5 | 2.5 | 1.00 | GOOD |
| 2.7 | 2.5 | 1.08 | GOOD |
| 3.0 | 2.5 | 1.20 | BETTER |
| 3.5 | 1.6 | 2.19 | BETTER |
| 4.5 | 1.5 | 3.00 | GOOD |

FIG. 19

| THICKNESS (μm) | 81 | 101 | 121 |
|---|---|---|---|
| EVALUATION | PERMISSIBLE | GOOD | GOOD |

DOUBLE-AEROSOL DEVICE

RELATED APPLICATION

This international application claims priority based on Japanese Patent Application No. 2012-141093 filed on Jun. 22, 2012, and entire contents of Japanese Patent Application No. 2012-141093 are incorporated in the international application.

TECHNICAL FIELD

The present invention relates to a double-aerosol device that discharges contents to the outside by a pressure of propellant.

BACKGROUND ART

A double-aerosol device is known which has a double container structure formed of an inner container storing contents and an outer container storing the inner container, and has a structure to discharge the contents to the outside by a pressure of propellant filled in a space between the outer container and the inner container. As the double-aerosol device of such a type, a duplex can container is widely used, in which two aerosol containers respectively store one inner bag (inner container) in one can (outer container) and are arranged in parallel, a first agent such as hair dye is stored in one inner bag and a second agent is stored in the other inner bag.

Meanwhile, a double-aerosol device that is configured such that two inner containers are stored in one outer container is also proposed (see PTL 1). Specifically, in order to grasp a remaining amount of contents based on a degree of deformation of the inner container, the double-aerosol device configured to store two inner bags (inner containers) formed in a tuck-folded pleat shape in a transparent outer container is disclosed in PTL 1.

CITATION LIST

Patent Literature

[PTL 1] JP-A-2001-122364

SUMMARY OF INVENTION

Technical Problem

It is difficult to visually determine the degree of the deformation of the pleat-shaped inner bag and is difficult to grasp the remaining amount of the content.

In one aspect of the invention, it is preferable that a remaining amount of content stored in a double-aerosol device be easily grasped.

Solution to Problem

A double-aerosol device of the invention includes: inner containers that separately store a plurality of types of hair treatment compositions used by mixing as a hair dye, decoloring agent, or dye remover; and an outer container in which a plurality of inner containers are stored. The double-aerosol device is configured such that the hair treatment compositions are discharged to the outside by contracting the inner containers by a pressure of propellant. Then, specifically, in the double-aerosol device, the outer container is configured such that at least a part of the inside of the outer container is visible so as to confirm remaining amounts of the hair treatment compositions. Furthermore, the inner containers store the hair treatment compositions in pouches. According to such a configuration, it is possible to confirm the remaining amounts of the hair treatment compositions by visibly confirming the inside of the outer container. Specifically, since the hair treatment compositions are stored in the pouches, it is possible to easily grasp the remaining amounts.

Furthermore, in the above configuration, an upper portion of an inner space of at least one of the inner containers may have a shape narrowing upward. According to such a configuration, since the hair treatment composition stored in the upper portion of the inner space is in a state of being closer to a center compared to a shape in which the upper portion of the inner space is not narrowed upward, it is possible to reduce the remaining amount of the hair treatment composition in the upper portion of the inner space.

Furthermore, in the above configuration, the inner container may be provided with a communication port discharging the hair treatment composition and a flow passage member extending from the communication port to the inside of the pouch may be provided. According to such a configuration, it is possible to prevent deformation of the pouch inhibiting the flow of the hair treatment composition stored in the inner container to the communication port.

BRIEF DESCRIPTION OF DRAWINGS

FIG. 16 is a view illustrating test results relating to the joint member.

FIG. 19 is a view illustrating test results relating to the pouch.

REFERENCE SIGNS LIST

1 . . . double-aerosol device, 11 . . . outer container, 12, 13 . . . inner container, 14 . . . valve unit, 15 . . . discharger, 111 . . . container body, 112 . . . exterior material, 113 . . . protruding leg part, 118 . . . outside window part, 121, 131 . . . pouch, 122, 132 . . . joint member, 123, 133 . . . inside flow passage, 124, 134 . . . headpart, 125, 135 . . . rod-shaped part, 126, 136 . . . slit, 127, 128 . . . rod, 129 . . . connecting part, 137 . . . through hole, 138 . . . concave part, 139 . . . opaque part, 141, 142 . . . stem, 151 . . . nozzle

DESCRIPTION OF EMBODIMENTS

Hereinafter, an embodiment to which the invention is applied will be described with reference to the drawings.

Figure 1:
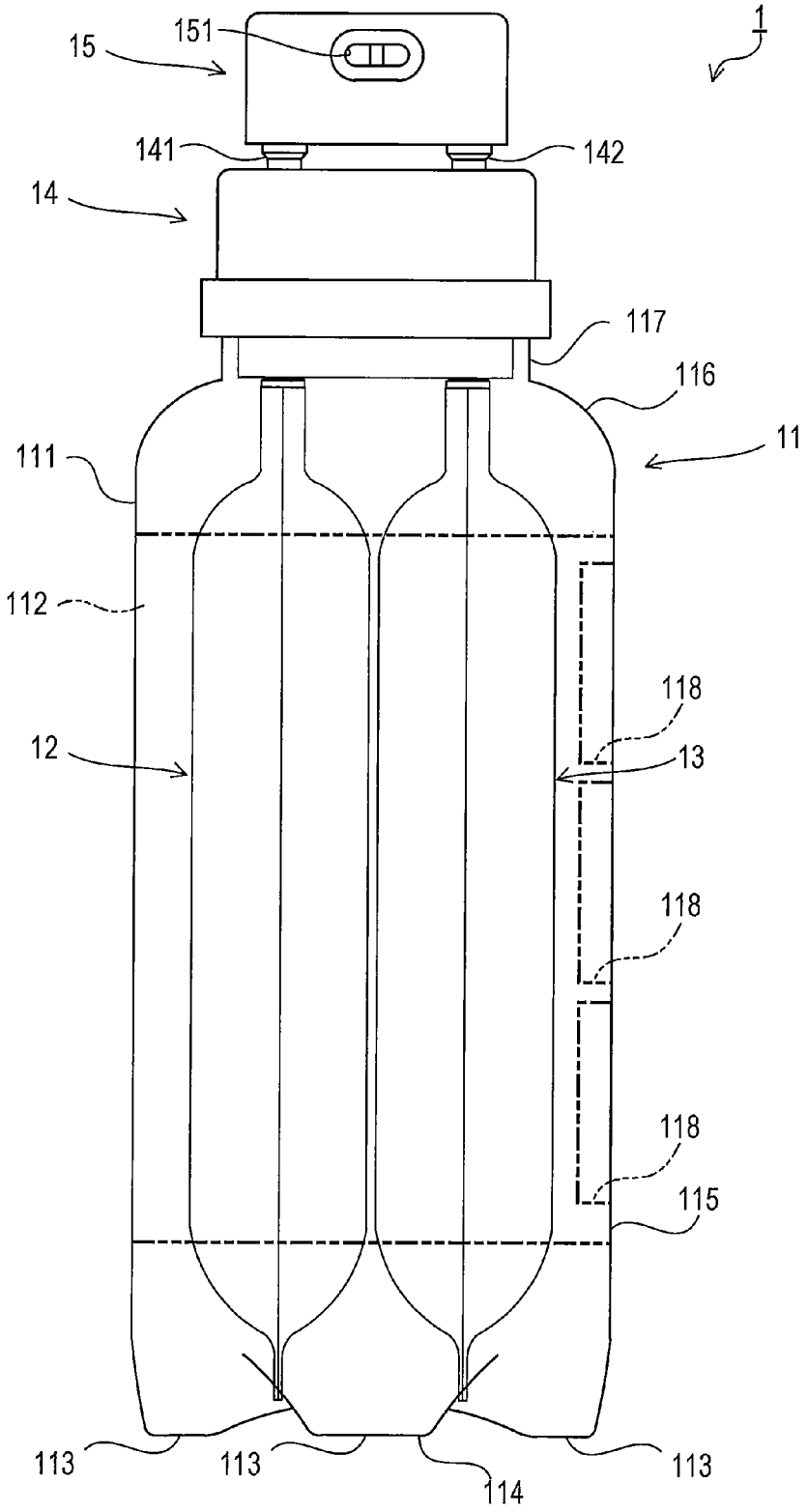
FIG. 1 is an external view of a double-aerosol device seen from a front side thereof.
Figure 2:
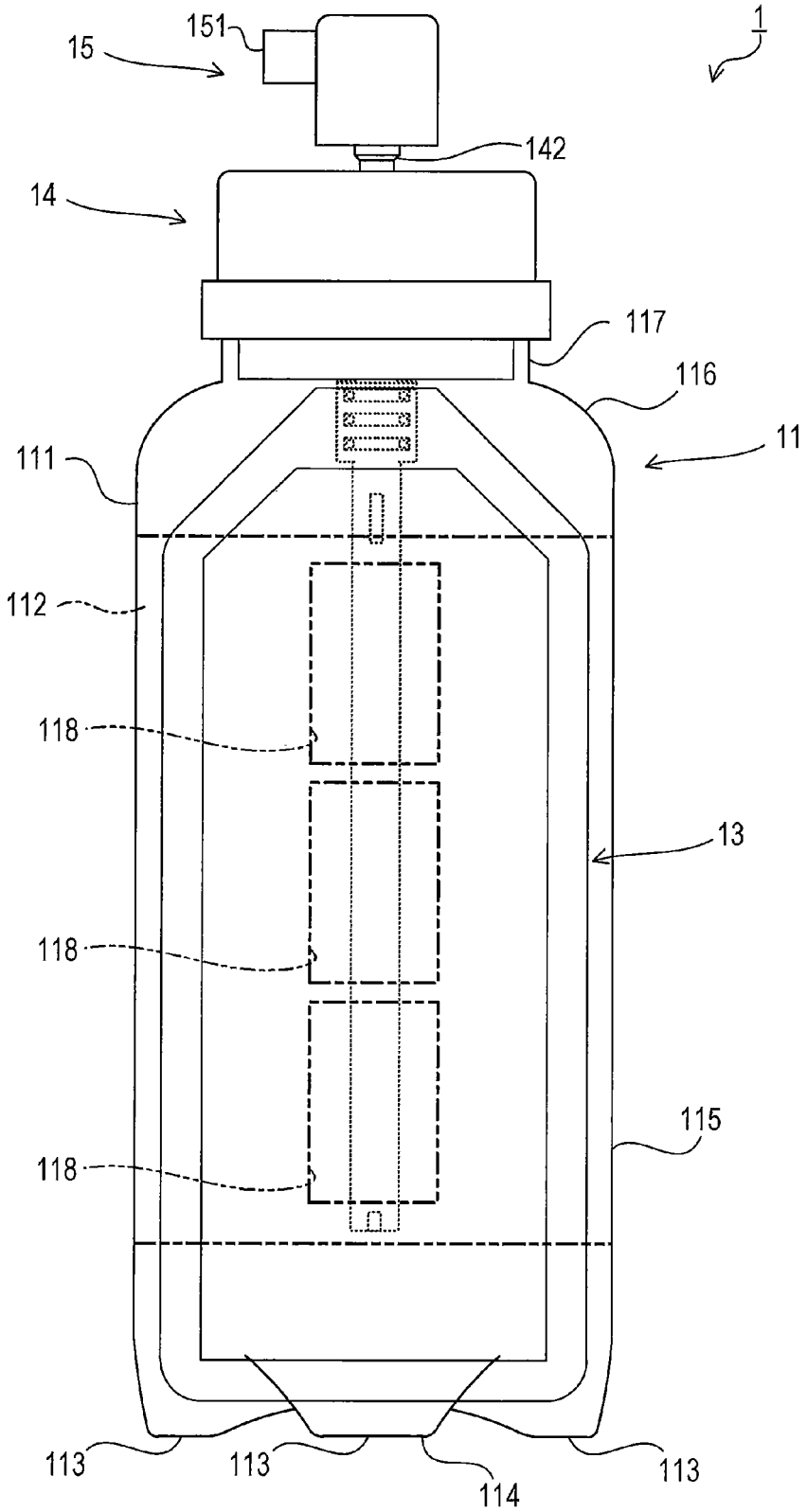
FIG. 2 is an external view of the double-aerosol device seen from a right side thereof.

As illustrated in FIGS. 1 and 2, a double-aerosol device 1 of the embodiment includes one outer container 11, two inner containers 12 and 13 stored in the outer container 11, a valve unit 14 provided in an upper portion of the outer container 11, and a discharger 15 provided in an upper portion of the valve unit 14.

First, a configuration of the outer container 11 will be described. The outer container 11 of the embodiment includes a container body 111 that is a main portion and a sheet-shaped exterior material 112 that is mounted on an external surface of the container body 111.

The container body 111 is a bottle container of which an entire surface is formed of a transparent resin (for example, PET). Specifically, the container body 111 includes a bottom part 114 that is a circular shape in a plan view having a plurality (for example, the number of approximately 3 to 6) of protruding leg parts 113, a cylindrical body part 115 of which a cross section is circular, a shoulder part 116 having a shape of which a diameter is reduced upward, and a cylindrical neck part 117. The bottom part 114, the body part 115, the shoulder part 116, and the cylindrical neck part 117 are integrally (as a component) formed. Moreover, the shape of the container body 111 is merely an example and is not limited thereto. For example, the shape thereof may not have the protruding leg part 113.

The exterior material 112 is a cylindrical resin sheet (for example, a shrink film). The exterior material 112 is mounted on an outer periphery of the body part 115 in the container body 111. A material of the exterior material 112 is a transparent resin (for example, PE, PP, PVC, PS, and PET). Various types of information such as a trade name, a using method, and a design image are displayed (printed and the like) in the exterior material 112. A portion in which the information is displayed in the exterior material 112 is opaque.

However, a transparent portion in which the display is not provided is secured in a position (in the example, in a position in which a second inner container 13 is seen in front of a first inner container 12) for visually recognizing the second inner container 13 in the exterior material 112. The transparent portion functions as an outside window part 118. That is, the second inner container 13 (specifically, a center portion in which a second joint member 132 is positioned in a second pouch 131 described below) is visually recognized from the outside through the outside window part 118. In the example, three rectangular outside window parts 118 are arranged in a vertical direction (up-down direction). Moreover, in FIGS. 1 and 2, in order to illustrate an entire image of the inner containers 12 and 13, the exterior material 112 is illustrated in a virtual line (two-dot chain line). Thus, originally, a portion (center portion in the inner containers 12 and 13 in the up-down direction) which is hidden by the exterior material 112 is also illustrated. Furthermore, the outside window part 118 may be formed in a form cutting out the exterior material 112.

Next, configurations of the inner containers 12 and 13 will be described. Two inner containers 12 and 13 are stored inside of the outer container 11 in parallel. Lower end portions of the inner containers 12 and 13 abut an upper surface (bottom surface) of the bottom part 114 in the container body 111. That is, the inner containers 12 and 13 are in a state of being mounted on the upper surface of the bottom part 114. Then, as illustrated in FIGS. 3A, 3B, 4A, and 4B, each of the inner containers 12 and 13 include pouches 121 and 131 that are bag bodies having a structure formed by bonding a peripheral portion of a sheet material, and joint members 122 and 132 that are fixed to communication ports (upper opening) thereof. Moreover, in FIGS. 3A and 4A, in order to illustrate an entire image of the joint members 122 and 132, the pouches 121 and 131 are illustrated in virtual lines (two-dot chain lines). Thus, originally, a portion (a part of the joint members 122 and 132) which is hidden by the pouches 121 and 131 and content is also illustrated. Furthermore, here, a configuration in which the lower end portions of the inner containers 12 and 13 abut the upper surface of the bottom part 114 is exemplified, but the invention is not limited to the configuration. The lower end portions of the inner containers 12 and 13 may be configured not to abut the upper surface of the bottom part 114. However, in the configuration in which the lower end portions of the inner containers 12 and 13 abut the upper surface of the bottom part 114, since a load is unlikely to be applied to welded parts with the joint members 122 and 132 in the pouches 121 and 131, leakage of the contents is unlikely to occur.

A first content is stored in the first pouch 121 used for the first inner container 12. Furthermore, a second content different from the first content is stored in the second pouch 131 used for the second inner container 13. In the embodiment, the first content and the second content are hair treatment compositions. More specifically, the first content and the second content are a first agent and a second agent that are used by mixing as a hair dye, decoloring agent, or dye remover.

The first agent contains an alkaline agent and the second agent contains hydrogen peroxide. In the second agent, since oxygen is generated by decomposing the hydrogen peroxide, it is necessary for the oxygen generated in the second inner container 13 to escape to the outside of the second inner container 13. In the double-aerosol device 1, a space outside the inner container is not independent as the duplex can container. Thus, for example, when the first inner container 12 and the second inner container 13 are stored in the common outer container 11, oxygen transported to the outside of the second inner container 13 may penetrate into the first inner container 12.

Thus, a multi-layered sheet material having high performance for blocking gas and liquid is used for the first pouch 121 used in the first inner container 12. Specifically, an opaque sheet material having a multi-layered (for example, six layers) structure in which a metal foil sheet, a resin sheet, and the like are laminated is used for the first pouch 121. A thickness of the first pouch 121 may be approximately 70 μm to 150 μm. Since the pouch 121 is easily crushed with the discharge of the content and the content can be squeezed by making the thickness be 150 μm or less, a stable discharge amount can be easily obtained until the very end. Furthermore, it is possible to prevent a flow passage and a hole of the content, and the like from blocking by completely crushing the pouch 121 as much as not keeping the original form by making the thickness be 70 μm or greater. Moreover, as a metal, for example, aluminum may be used and as a resin, for example, ethylene-vinyl alcohol copolymers (EVOH) may be used. For example, the thickness of the aluminum layer may be 5 μm to 20 μm.

Meanwhile, a sheet material having a property (gas permeable) in which gas passes through but liquid does not pass through is used for the second pouch 131 used in the second inner container 13. Specifically, a transparent sheet material having a single-layered or multi-layered structure using a resin sheet is used. For example, a thickness of the second pouch 131 may be 70 μm to 150 μm for the same reason as that of the first pouch 121. Moreover, for example, as the resin, polyester such as polyethylene may be used.

Figure 5:
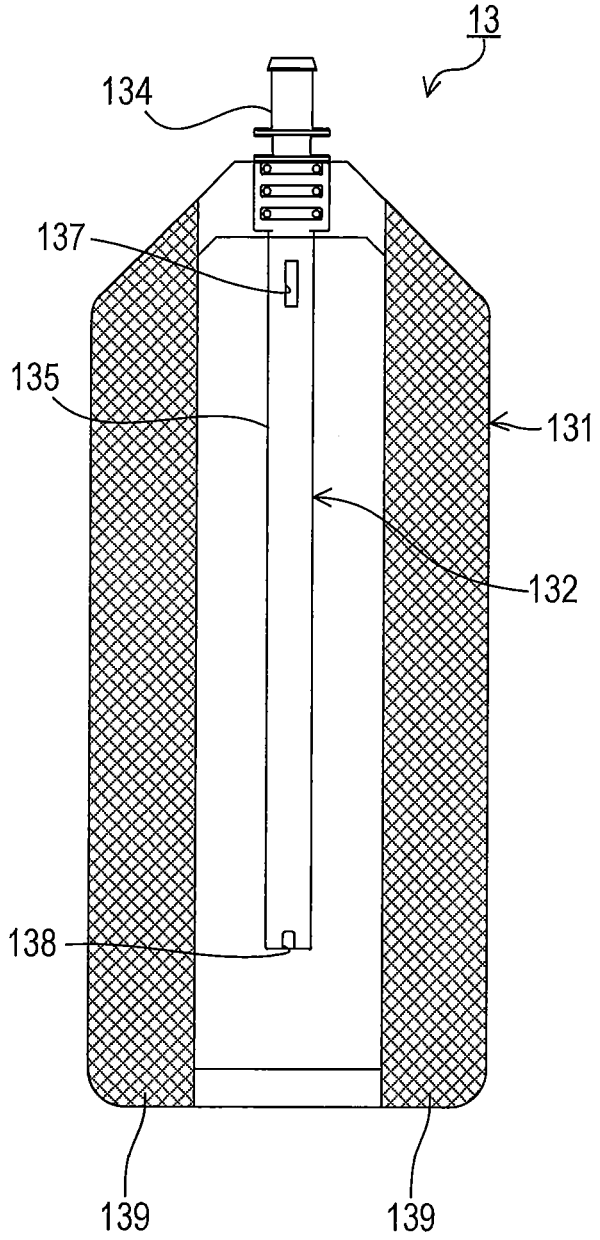
FIG. 5 is an external view of a second inner container of an embodiment.

That is, the first pouch 121 is opaque, but the second pouch 131 can be transparent. An entire surface of the second pouch 131 can be transparent, but in the embodiment, as illustrated in FIG. 5, opaque parts 139 are formed at both of the right and left portions. The opaque part 139 may be directly formed (printing and the like) on a sheet material configuring the second pouch 131 or may be formed on the pouch surface by bonding another sheet. That is, in the second pouch 131, the center portion is transparent other than at both of the right and left portions and the inside can be visually recognized in the center portion thereof.

Figure 3A:
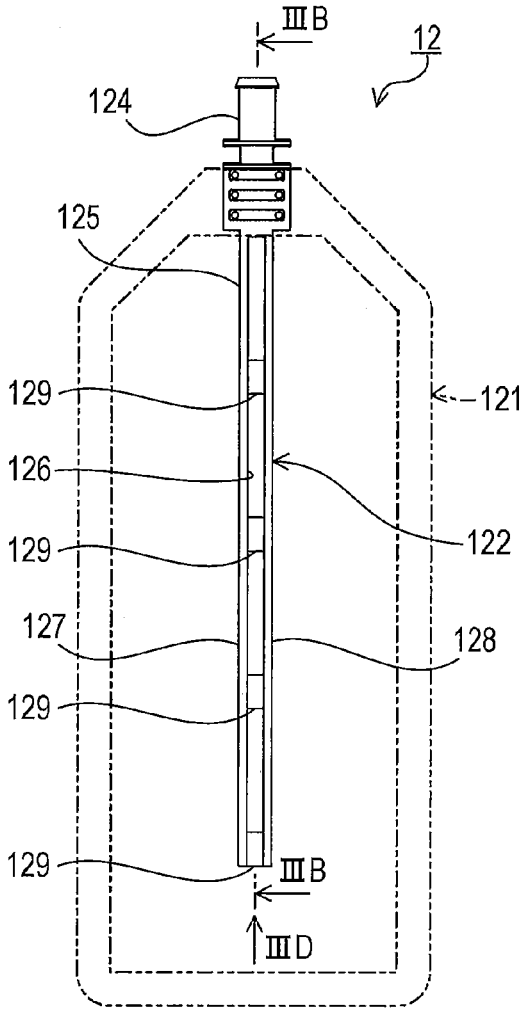
FIG. 3A is an external view of a first inner container.
Figure 3B:
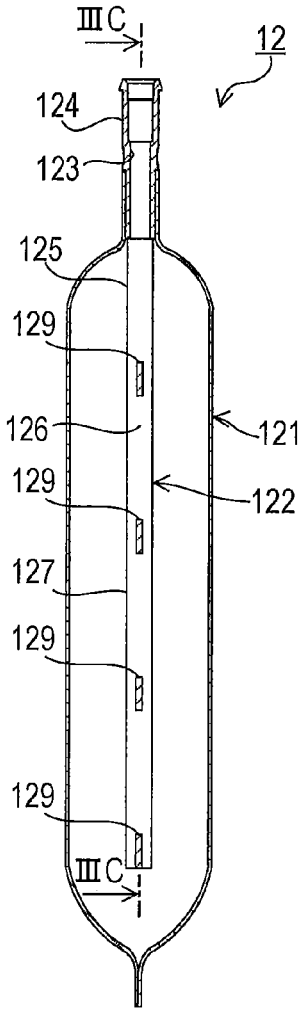
FIG. 3B is a cross-sectional view that is taken along line IIIB-IIIB of FIG. 3A.
Figure 3C:
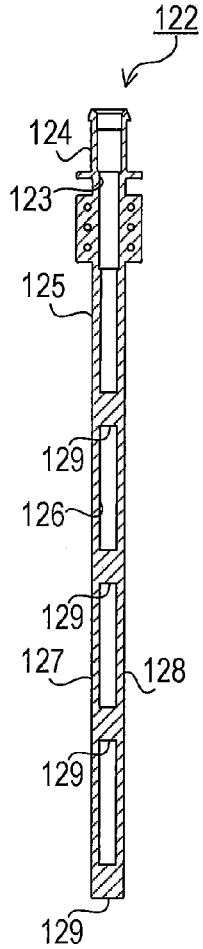
FIG. 3C is a cross-sectional view that is taken along line IIIC-IIIC of FIG. 3B.
Figure 3D:
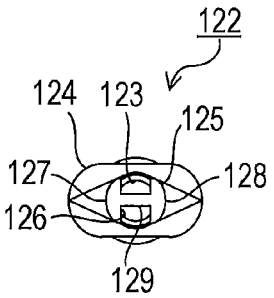
FIG. 3D is an arrow view of line IIID of FIG. 3A.
Figure 4A:
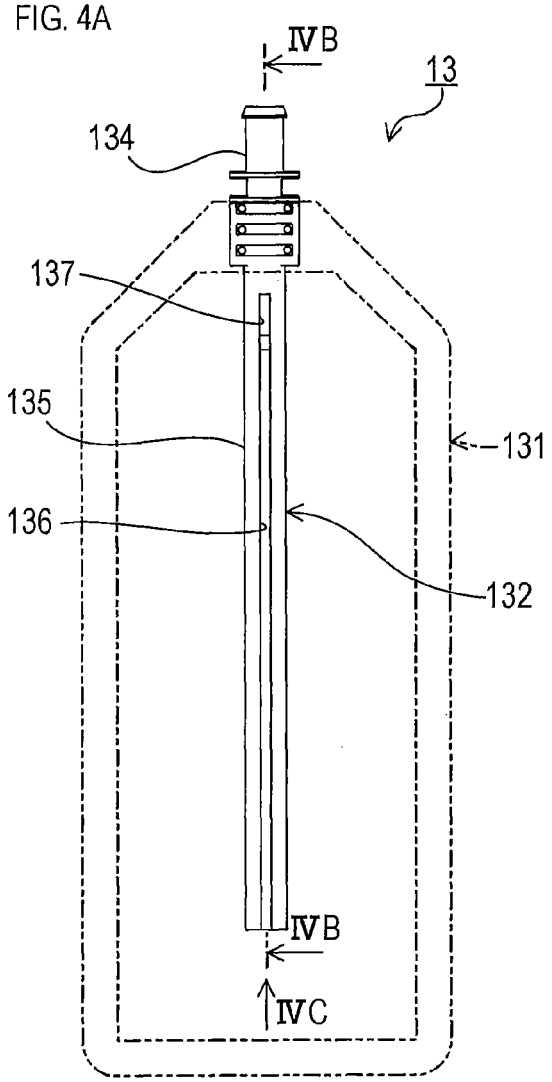
FIG. 4A is an external view of a second inner container.

Moreover, in the embodiment, the first pouch 121 and the second pouch 131 are designed to be a common shape. As illustrated in FIGS. 3A and 4A, outer shapes of the pouches 121 and 131 are substantially rectangular shapes. Specifically, the pouches 121 and 131 have shapes in which both upper ends are formed being inclined linearly and are gradually narrowed upward. Similarly, inner spaces (spaces in which the contents are stored) of the pouches 121 and 131 also have shapes in which both rectangular upper ends are formed being inclined linearly and welded, and are gradually narrowed upward. Thus, it is possible to reduce a remaining amount of the content. Furthermore, corner parts in outer shapes of the pouches 121 and 131 are round (arc shaped) so as not to cause interference with the outer container 11. Moreover, for example, angles of the inclined portions of both of the upper ends may be 30 degrees to 60 degrees with respect to the vertical direction.

A linear portion is ensured in an upper end center portion of the inner space in a lateral direction (horizontal direction). This is because the upper end center portions (portions into which the joint members 122 and 132 are inserted) of the pouches 121 and 131 are easily welded in a state where the joint members 122 and 132 are inserted into the pouches 121 and 131 in a manufacturing process of the inner containers 12 and 13. Specifically, from the viewpoint of being capable of favorably welding, for example, a length of the linear portion may be 10 mm or greater. Meanwhile, from the viewpoint of blocking the content in the upper portion of the inner space to the center, for example, the length of the linear portion may be 35 mm or less (preferably 30 mm or less). That is, it is possible to increase an effect of easily discharging the content in the upper portion of the inner space while easily performing the welding in the manufacturing process by making the length of the linear portion in the upper end center of the inner space be, for example, 15 mm or greater and 35 mm or less. For such a reason, for example, if the lateral width of the inner space does not exceed 35 mm, such an effect may be obtained without forming the upper portion of the inner space to be narrowed (for example, even a usual rectangular shape). Meanwhile, if the lateral width of the inner space exceeds 35 mm, such an effect may be obtained by forming the upper portion of the inner space to be narrowed.

The joint members 122 and 132 form flow passages for discharging the contents to the outside in the communication ports of the pouches 121 and 131 and are intended to hardly inhibit the flow of the contents in the inner space by bending of the pouches 121 and 131, and the like. In the embodiment, shapes of the first joint member 122 used for the first inner container 12 and the second joint member 132 used for the second inner container 13 are different from each other. However, the invention is not limited to the embodiment and any one of the joint members may be used for both inner containers. That is, the joint members having the same shape may be used. According to the configuration in which the joint members having the same shape are used, it is possible to increase production efficiency compared to a case where the joint members having different shapes are used. In addition, since the pouches 121 and 131 are crushed similarly, it is possible to easily grasp the remaining amount. Furthermore, for example, if viscosity and stickiness of the first content and the second content are substantially the same as each other, it is possible to easily discharge the first content and the second content at a substantially similar amount by using the same joint member.

As illustrated in FIGS. 3A to 3D, the first joint member 122 includes a cylindrical head part 124 that forms an inside flow passage 123 in which the content passes through the communication port of the first pouch 121 and a rod-shaped part 125 that is inserted into the first pouch 121. The head part 124 and the rod-shaped part 125 are integrally molded with a resin.

A slit 126 passing through the front and back sides is linearly formed in the rod-shaped part 125 in the vertical direction (up-down direction). In other words, the rod-shaped part 125 has a shape in which two parallel rods 127 and 128 are disposed on the right and left with a gap therebetween. However, connecting parts 129 connecting the rods 127 and 128 are provided in a plurality of locations (in the example, four locations having a constant interval) having a gap each other between two rods 127 and 128. That is, the rod-shaped part 125 has an entire ladder shape. Moreover, a thickness dimension of the connecting part 129 is shorter than thickness dimensions of two rods 127 and 128 respectively so as not to close an open flow passage (flow passage formed between the slit 126 and the inner surface of the pouch) formed by the slit 126 (see FIG. 3B). Thus, a cross-sectional shape (cross-sectional shape of the rod-shaped part 125 in an axial direction) of a portion in which the connecting part 129 is provided becomes an H shape (see FIG. 3D).

Figure 4B:
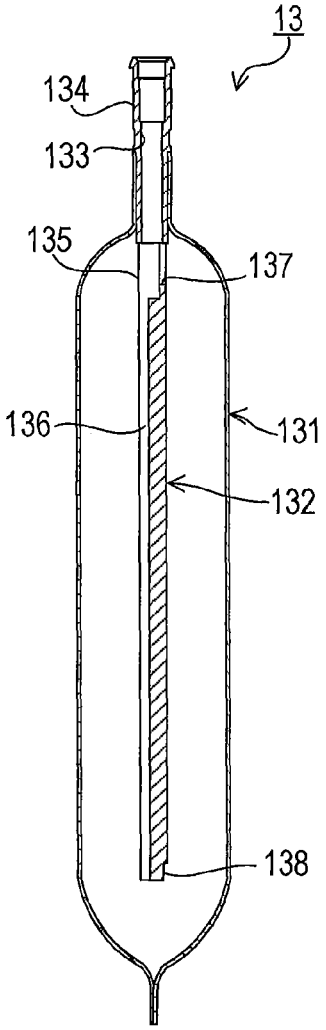
FIG. 4B is a cross-sectional view that is taken along line IVB-IVB of FIG. 4A.
Figure 4C:
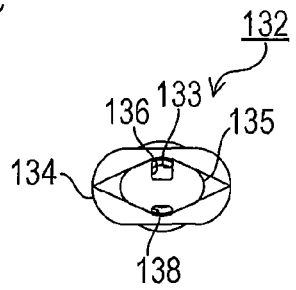
FIG. 4C is an arrow view of line IVC of FIG. 4A.

Meanwhile, as illustrated in FIGS. 4A to 4C, the second joint member 132 includes a cylindrical head part 134 forming an inside flow passage 133 in which the content passes through the communication port of the second pouch 131 and a rod-shaped part 135 that is inserted into the inside of the second pouch 131. The head part 134 and the rod-shaped part 135 are integrally molded by a resin.

A cross section of the rod-shaped part 135 orthogonal in the axial direction is a substantially oval shape (specifically, a shape in which corner portions of a diamond shape are arc shapes) (see FIG. 4C). In the rod-shaped part 135, a lateral width dimension (length of a width in a direction along the surface of the second pouch 131 and in a lateral direction in FIG. 4C) is longer than a thickness dimension (length of a width in a direction orthogonal to the surface of the second pouch 131 and in the vertical direction in FIG. 4C). Furthermore, the thickness dimension of the rod-shaped part 135 is designed to match with a thickness dimension of a welding portion having a cross section of the diamond shape in a portion which is a lower portion of the head part 134 and in which the pouch 131 is welded. Thus, in the manufacturing process for welding the pouch 131, the pouch 131 is likely to be along the welding portion of the joint member 132 (unlikely to lift from the welding portion) and the welding is easily performed. Furthermore, since the cross section of the rod-shaped part 135 is the oval shape in which the thickness dimension is shorter than the lateral width dimension, it is possible to reduce a gap (space in which the content is likely to remain) formed at both right and left sides of the rod-shaped part 135 in a state where almost all content is discharged. Thus, the amount of the content remaining in the pouch 131 is reduced.

Then, in the rod-shaped part 135, a linear slit 136 is formed in a surface (surface on a left side in FIG. 4B and hereinafter, referred to as "inwardly facing surface") facing a side of the first inner container 12 in the vertical direction (up-down direction) to the lower end. A depth of the slit 136 becomes deeper in a stepwise fashion in an upper portion thereof. A through hole 137 passing through a surface (surface on a right side in FIG. 4B and hereinafter, referred to as "outwardly facing surface") opposite to the inwardly facing surface in the uppermost end of the slit 136 is formed. Moreover, from the viewpoint of maintaining a strength of the rod-shaped part 135 (difficult the bend) and from the viewpoint of hardly crushing the flow passage formed by the slit 136, for example, a depth of the slit 136 may be 20% to 50% of the thickness dimension of the rod-shaped part 135. Furthermore, as another expression, the depth of the slit 136 may be 0.5 mm or greater and a thickness dimension of a remaining portion (a portion to be thin enough to deepen the slit 136) by the slit 136 may be 1.5 mm or greater. Furthermore, from the viewpoint of hardly biting the pouch 131 in the slit 136, for example, the lateral width dimension of the slit 136 may be 0.5 mm to 3 mm. Furthermore, the width dimension of the slit 136 may be a shape widening upward in a stepwise fashion. Furthermore, the shape is not limited to the stepwise fashion and may be obliquely widened (deepened) upward.

Meanwhile, the slit such as the inwardly facing surface is not formed in the outwardly facing surface and a concave part 138 is formed in the lower end portion. The concave part 138 is a part that becomes a gate when molding the joint member 132 with a resin and has a concave shape so as not to damage the pouch 131 due to protrusion of burr. Moreover, the lower end portion of the rod-shaped part 135 is the gate because the rod-shaped part 135 is long and rigidity thereof is high.

Furthermore, a color of the outwardly facing surface is different from a color (opaque color, and white in the embodiment) of the second content and displays a color (yellow in the embodiment) that can be easily visually recognized. Such a display function is realized by coloring the material itself of the second joint member 132 yellow. Therefore, in the example, a portion other than the outwardly facing surface is yellow. However, the color is not limited to the configuration. For example, an exterior material (for example, seal) of a color that can be visually recognized may be mounted on at least the portion of the outwardly facing surface in the second joint member 132 formed by a color material other than the color that can be easily visually recognized. Moreover, the color of the outwardly facing surface is merely an example and is not limited to yellow, and, for example, may be red.

Furthermore, the lateral width of the rod-shaped part 135 of the second joint member 132 is designed to be slightly greater than that of the rod-shaped part 125 of the first joint member 122. This is because the outwardly facing surface is likely to be visually recognized by increasing an area of the outwardly facing surface. That is, the outwardly facing surface functions as a gauge for grasping the remaining amount of second content from the outside of the outer container 11.

Next, a configuration of the valve unit 14 will be described. The valve unit 14 includes two valves respectively corresponding to two inner containers 12 and 13, valve holders fixing two valves in parallel, mountain covers fixing the valve holders to an opening part of the outer container 11, and the like. A first valve is connected to the upper end portion of the first joint member 122 and opens and closes a discharge flow passage of the content stored in the first pouch 121. In other words, the first joint member 122 communicates with the inside of the first pouch 121 and the first valve. Similarly, a second valve is connected to the upper end portion of the second joint member 132 and opens and closes a discharge flow passage of the content stored in the second pouch 131. In other words, the second joint member 132 communicates with the inside of the second pouch 131 and the second valve. Each valve includes vertically movable stems 141 and 142, and the flow passage is opened by pressing the stems 141 and 142 down. Moreover, since the configuration itself of such a valve unit 14 is known, the structure thereof is simply illustrated and the detailed description thereof will be omitted. Furthermore, the configuration described here is an example and may be replaced by another configuration having a similar function. For example, a stem of a type in which the flow passage is opened by inclining the stem may be used instead of the stem of the type in which the flow passage is opened by pressing the stem down.

Moreover, if the pouches 121 and 131 interfere with each other, one having low viscosity of the stored contents is respectively pressed and easily discharged, and a discharging ratio may be shifted from a desired ratio. Thus, for example, the gap between the stems 141 and 142 may be designed to be a length of 50% or greater (preferably a length of 60% or more) of the maximum value (bulged width before discharging the content) of the thickness dimension of the pouches 121 and 131. Furthermore, for example, the amount of the contents stored in the inner containers 12 and 13 may be 90% or less of a full capacity (storable maximum value). Thus, it can be difficult for the pouches 121 and 131 to interfere with each other. Moreover, the full capacity described here means a capacity immediately before (limit full) the water overflows by a restoring force of the pouches 121 and 131 after continuously injecting the water into vacant inner containers 12 and 13.

A space inside of the outer container 11 and outside of the inner containers 12 and 13 is sealed by the valve unit 14 and propellant (for example, compressed gas) is filled in the sealed space. Two pouches 121 and 131 are always pressed by the propellant and are configured such that the contents are discharged to the outside by compressing the inner containers 12 and 13 by the pressure of the propellant. After degassing the inside of the outer container 11 and filling the contents in the inner containers 12 and 13 in a state where the inner containers 12 and 13 are mounted on the valves and are stored in the outer container 11. Thereafter, the propellant is filled in the outer container 11. When degassing the inside of the outer container 11, the mountain cover is in a state of being slightly apart from the outer container 11. Even in this state, the length of the inner containers 12 and 13 in the up-down direction is designed such that the inner containers 12 and 13 are in a state of abutting and being mounted on the upper surface (bottom surface) of the bottom part 114 in the outer container 11 (container body 111). Moreover, the length of the inner containers 12 and 13 in the up-down direction is a length that is obtained by adding the length of the pouches 121 and 131 in the up-down direction and the length of the joint members 122 and 132 protruding from the upper portion of the pouches 121 and 131 in the up-down direction.

Next, a configuration of the discharger 15 will be described. The discharger 15 has an inside flow passage that merges and discharges the first content and the second content discharged from the stems 141 and 142 from a nozzle 151. Specifically, the discharger 15 is vertically movable and simultaneously presses two stems 141 and 142 by pressing the upper surfaces thereof downward. Thus, the first valve and the second valve are simultaneously opened and the contents are simultaneously discharged from the inner containers 12 and 13. Moreover, since the configuration itself of such a discharger 15 is known, the configuration is simply illustrated and detailed description will be omitted.

Next, a using method of the double-aerosol device 1 will be described.

In a state before use, two inner containers 12 and 13 are respectively filled with the contents.

In this state, when pressing the discharger 15 downward and two valves of the valve unit 14 are simultaneously opened, the first content and the second content are simultaneously discharged. Specifically, the contents are respectively discharged to the outside in the pouches 121 and 131. At this time, the contents present on the upper side are sequentially discharged in the inner spaces of the pouches 121 and 131.

Thus, in the second inner container 13, the outwardly facing surface of the rod-shaped part 135 of the joint member 132 is gradually exposed from the upper portion according to the reduction of the second content. The outwardly facing surface of the exposed rod-shaped part 135 as described above can be visually recognized through the outside window part 118 from the outside of the outer container 11 so that it is possible to grasp the remaining amount of the second content.

Moreover, the first content and the second content are designed to be discharged at a constant ratio (1:1 in the embodiment) and to be able to be used up simultaneously. Thus, it is possible to grasp the remaining amount of the first pouch 121 based on the remaining amount of the second pouch 131.

As described above, the double-aerosol device 1 of the embodiment includes two inner containers 12 and 13 which respectively store the hair treatment compositions (first agent and second agent) that are used by mixing as the hair dye, the decoloring agent, or the dye remover, and the outer container 11 storing the two inner containers 12 and 13. The double-aerosol device 1 is configured to discharge the contents (hair treatment compositions) to the outside by contracting the inner containers 12 and 13 by the pressure of the propellant. Thus, specifically, in the double-aerosol device 1, the outer container 11 is configured such that at least a part of the inside of the outer container 11 can be visually recognized. Thus, the remaining amount of the contents can be visually recognized. Thus, according to the double-aerosol device 1 of the embodiment, since the inside of the outer container 11 is visually recognized, it is possible to recognize the remaining amount of the contents.

Furthermore, the inner containers 12 and 13 store the contents in the pouches 121 and 131. Then, a transparent portion is formed in the second pouch 131 and the inside thereof can be visually recognized. Thus, it is possible to easily grasp the remaining amount of the contents. Specifically, in the configuration in which the first inner container 12 and the second inner container 13 are stored in the common outer container 11, since the space outside the inner container is not independent as the duplex can container, a high cutoff performance is required in the inner containers 12 and 13 to avoid contact and reaction of the first content and the second content such as described in paragraph 0019. In this regard, since the pouch is a structure that is provided by bonding the peripheral portion of the sheet material and can be formed by using a sheet material of a multi-layered structure (for example, six layers) in which a degree of freedom of the material is high, it is possible to realize a high blocking performance. Furthermore, if it is the pouch, since a surface close to a plane is widely formed, it is possible to increase the visibility. In addition, since the opaque parts 139 are formed in both right and left portions of the second pouch 131, the content easily remaining (technically difficult to discharge) in the end portion of the pouch 131 is not visually recognized. So, it is possible to avoid grasping the remaining amount by mistake.

Furthermore, the inner containers 12 and 13 include the joint members 122 and 132 extending from the communication ports discharging the contents to the inside of the pouches 121 and 131. Thus, it is possible to prevent the deformation of the pouches 121 and 131 that inhibits the flow of the contents stored in the pouches 121 and 131 to the communication ports and it is possible to easily discharge the contents until the very end.

Furthermore, in the pouches 121 and 131, since the upper portion of the inner space has the shape to be narrowed upward, the content stored in the upper portion of the inner space is closer to the center than that of a shape in which the upper portion of the inner space is not narrowed. Specifically, since the content of the upper portion in the inner space is positioned closer to the joint member 122 and is easily discharged, it is possible to reduce the remaining amount of the content in the upper portion of the inner space. Furthermore, since the contents in the upper portions of the inner spaces are initially discharged and the contents are likely to sequentially discharge from the upper side by the flowing thereof, the contents stored in the pouches 121 and 131 are likely to be sequentially reduced from the upper portion in the inner spaces of the pouches 121 and 131. As a result, it is possible to relatively accurately grasp the remaining amount of the contents by visual reorganization from the outside. Furthermore, since a center of gravity of the pouches 121 and 131 is low, it is possible to increase stability when mounting the double-aerosol device 1.

Furthermore, in the second joint member 132, since the lateral width dimension is elongated and the outwardly facing surface that is visually recognized as the gauge is widely formed, it is possible to increase the visibility of the remaining amount. Specifically, since the slit 136 is formed in the inwardly facing surface in the rod-shaped part 135 and the slit is not formed in the outwardly facing surface, the second content more easily flows on the side of the inwardly facing surface than on the side of the outwardly facing surface. Thus, the outwardly facing surface is unlikely to be hidden in the second content and the color of the outwardly facing surface is likely to be visually recognized.

Furthermore, since the shapes of the first joint member 122 and the second joint member 132 are different from each other, a discharging ratio of the first content and the second content of which the stickiness is different can be closer to a desirable ratio. Specifically, the width of the slit 126 formed in the rod-shaped part 125 is wider than the width of the slit 136 formed in the rod-shaped part 135 (an area of the formed flow passage is large). Thus, the discharge amount of the first content of which the stickiness is ordinarily higher than that of the second content can be closer to the discharge amount of the second content.

Above, the embodiment of the invention is described, but the invention is not limited to the embodiment described above and, of course, the invention may take various forms. For example, the invention may be configured as follows.

(1) Configuration of Outer Container for Visually Recognizing Remaining Amount of Content In order to visually recognize the remaining amount of the content from the outside of the outer container 11, it is necessary for at least apart of the outer container 11 to have a light-transmitting property (transparent or semi-transparent). In the embodiment described above, the outer container 11 of the configuration in which the exterior material 112 is mounted on the container body 111 formed by a transparent material and the inside is visually recognized from the outside window part 118 provided in the exterior material 112 is exemplified, but the invention is not limited to the embodiment. For example, the shape, the size, the position, the number, and the like of the outside window part are not specifically limited as long as the remaining amount of the content can be visually recognized. Furthermore, for example, one container body 111 in which characters, drawings, and the like are directly formed (printing and the like) may be the outer container without using the exterior material 112. Furthermore, for example, an entire surface may be transparent as the outer container without forming the opaque portion.

Figure 6:
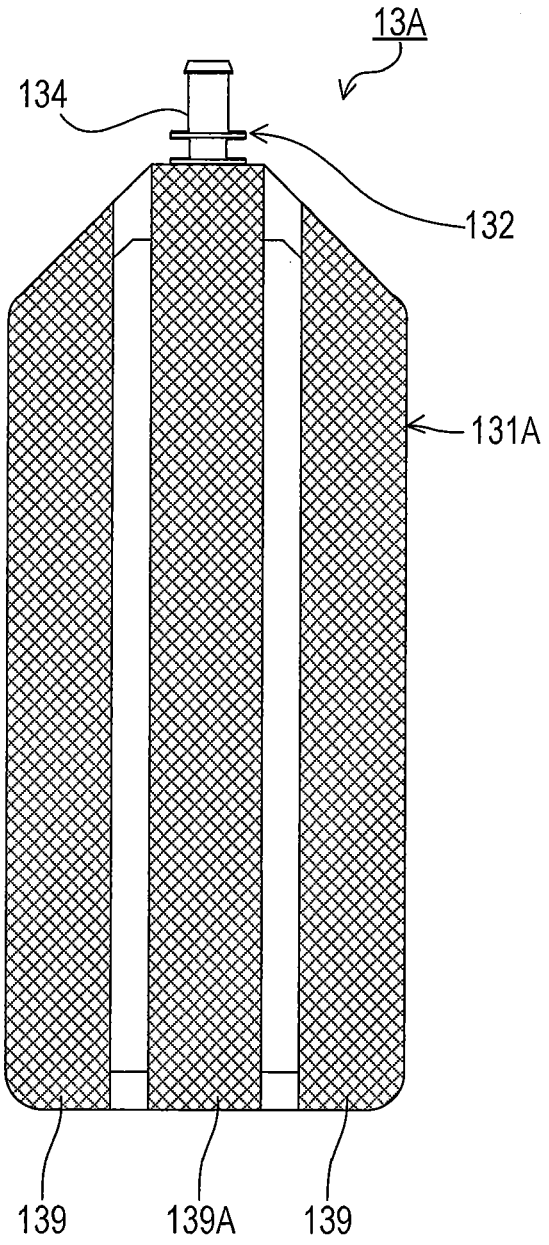
FIG. 6 is an external view of a second inner container of a modified example.

(2) Configuration of Inner Container for Visually Recognizing Remaining Amount of Content In the embodiment described above, the inner containers 12 and 13 in which the remaining amount of the contents can be visually recognized by making the center portion of the second pouch 131 other than the both right and left portions be transparent is exemplified (FIG. 5). According to such a configuration, since the content easily remaining (technically difficult to discharge) in the both right and left portions cannot be visually recognized, it is possible to avoid grasping the remaining amount by mistake. However, the invention is not limited to such a configuration. For example, the shape, the size, the position, the number, and the like of the transparent portion in the second pouch are not specifically limited as long as the remaining amount of the content can be visually recognized. Specifically, for example, as a second pouch 131A of a second inner container 13A illustrated in FIG. 6, an opaque part 139A covering the rod-shaped part 135 may be formed in the center portion in addition to the opaque parts 139 in the both right and left portions. Thus, the content easily remaining (technically difficult to discharge) in the both sides of the rod-shaped part 135 is not visually recognized while visually recognizing the content present only by both right and left sides of the rod-shaped part 135 and it is possible to avoid grasping the remaining amount by mistake.

Furthermore, for example, the sheet material of one side (side of the first inner container 12) configuring the second pouch is opaque and a transparent portion may be provided in the other sheet material. Thus, it is possible to grasp the remaining amount by visually recognizing the information such as the color, the character, and the symbol displayed inside of the opaque sheet material through the sheet material in which the transparent portion is provided. Furthermore, the transparent portion is not limited to a part of the second pouch and an entire surface of the second pouch may be transparent.

Furthermore, the invention is not limited to the configuration in which at least a part of the pouch is transparent. A degree of the deformation of the pouch can be visually recognized and the remaining amount of the content may be grasped based on the degree of the deformation thereof. Since orientation of the pouch to be deformed is specified compared to another bag-shaped container, there is an advantage that the remaining amount is easily grasped based on the degree of the deformation. Specifically, as the embodiment described above, it is possible to relatively accurately grasp the remaining amount of the content based on the degree of the deformation of the pouches 121 and 131 as long as the contents are sequentially discharged from the upper side in the pouches 121 and 131.

(3) Shape of Pouch

In the embodiment described above, the pouches 121 and 131 having the shape of which the both upper ends of the inner space are inclined and which is linearly formed are exemplified, but the invention is not limited to the embodiment and, for example, may have a shape as illustrated below. Moreover, the shape as illustrated below may be applied to one of the first content and the second content or may be applied to both sides. Furthermore, the second joint member 132 is exemplified as the flow passage member, but is merely an example and the invention is not limited to the embodiment.

Figure 7:
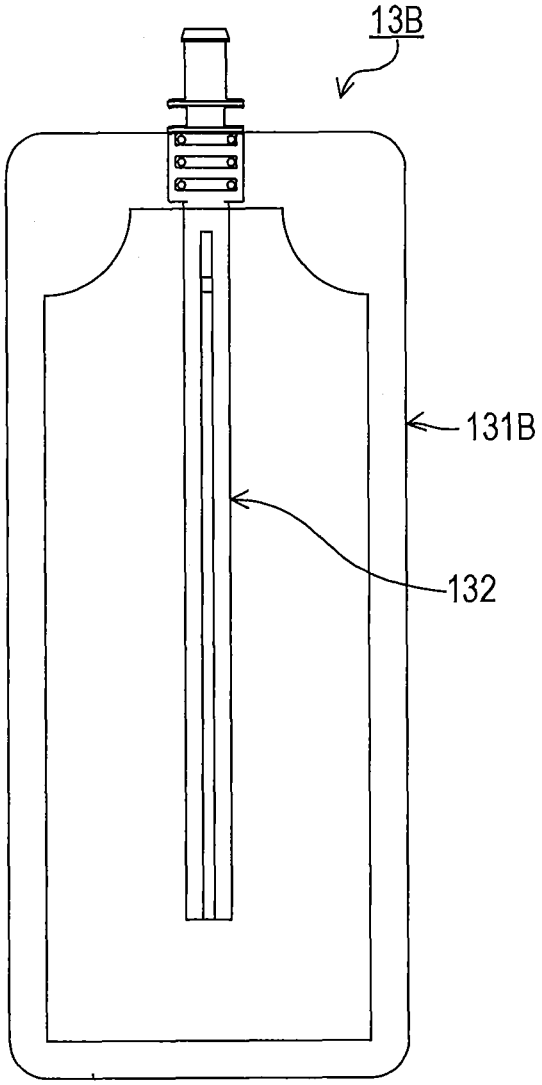
FIG. 7 is an external view of a pouch having a shape in which both ends of an upper portion of an inner space are inwardly recessed.

For example, as a second pouch 131B of a second inner container 13B illustrated in FIG. 7, both upper ends of the inner space are not in a linear shape but may be in an inwardly recessed shape (in the example, an arc shape). The shape illustrated in FIG. 7 has more prominent features that the lateral width is narrower as the upper position in the inner space. According to the shape illustrated in FIG. 7, it is possible to improve the effect that the remaining amount of the content is reduced in the upper portion of the inner space and to improve the effect that the content is easily discharged sequentially from the upper side of the inner space. Here, as the embodiment described above, the upper portion of the outer shape of the pouch may be narrow to match the shape of the inner space. However, as illustrated in FIG. 7, for the outer shape, it is possible to reduce a gap generated between the inner wall of the outer container 11 and the pouch 131B, and to narrow a movable range of a pouch 131B by not narrowing (increasing the width of the welded parts in the both upper end corner portions) the width of the upper portion. As a result, for example, if the outer container 11 is upside down (specifically, when falling), it is possible to reduce a moving amount of the pouch 131B and it can be unlikely that the lower end of the joint member 132 breaks through the pouch 131B.

Figure 8C:
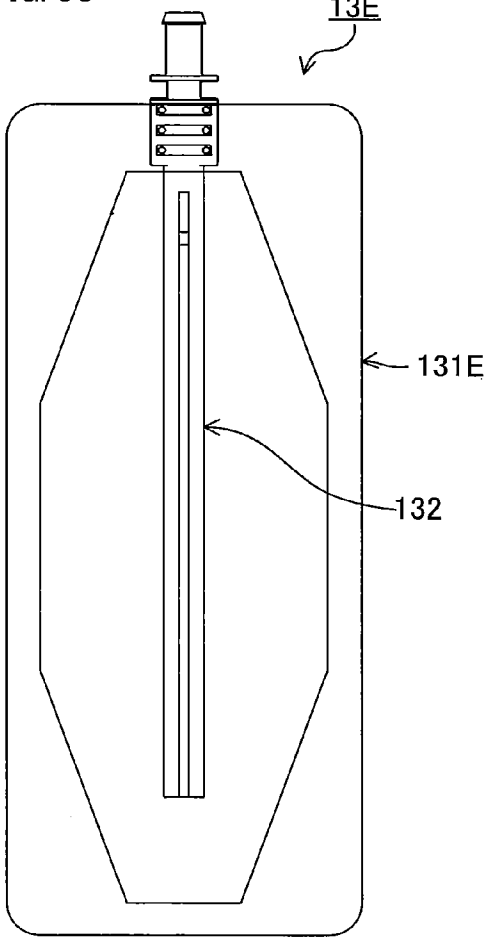
FIG. 8C is an external view of the pouch having a shape in which an upper portion of the inner space is gradually narrowed upward and a lower portion is gradually narrowed downward.
Figure 8B:
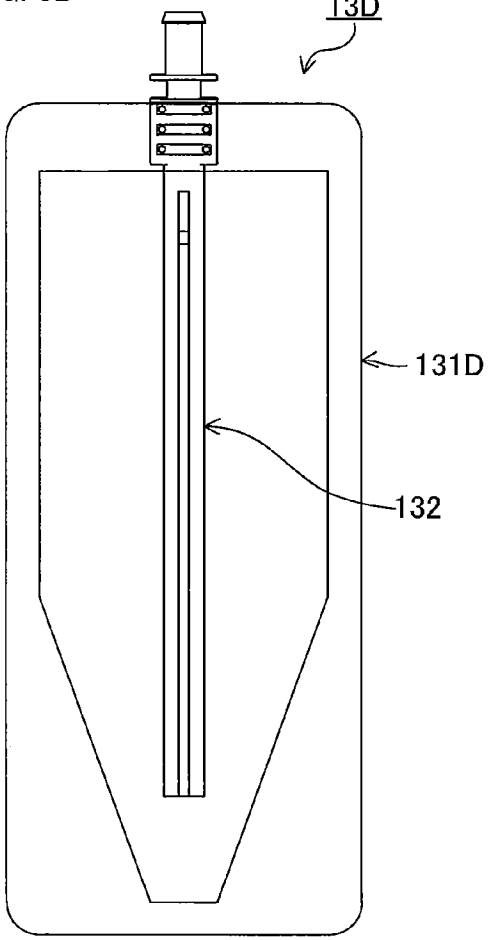
FIG. 8B is an external view of the pouch having a shape in which a lower portion of the inner space is gradually narrowed downward.
Figure 8A:
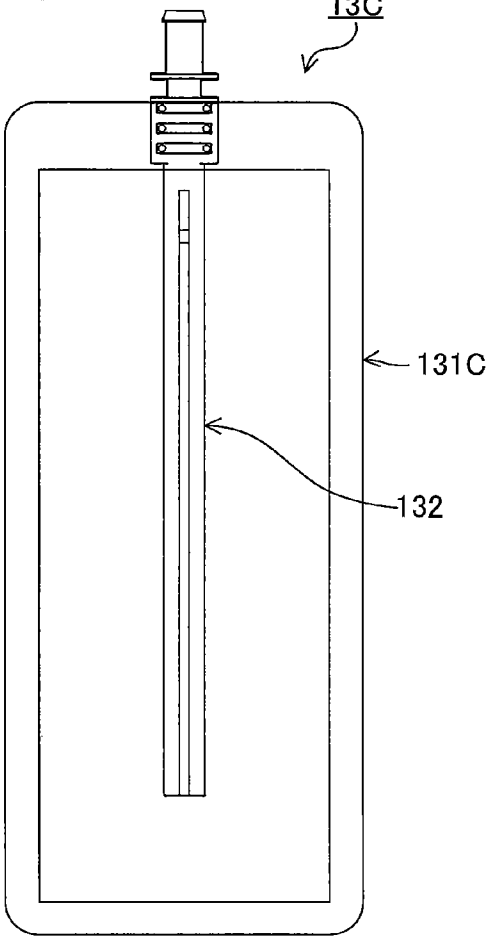
FIG. 8A is an external view of a pouch having a shape in which a horizontal width of an inner space is constant.

Meanwhile, for example, as a second pouch 131C of a second inner container 13C illustrated in FIG. 8A, the lateral width of the inner space may be a constant (in the example, rectangular shape) shape. Furthermore, for example, as a second pouch 131D of a second inner container 13D illustrated in FIG. 8B, the lower portion of the inner space may be gradually narrowed downward. Specifically, the content (first content in the embodiment described above) having a high viscosity easily remains in the lower portion of the inner space, and it is possible to reduce the remaining amount by narrowing the lower portion. Thus, the example may be applied to a part (the first pouch 121 in the embodiment described above) of a plurality of pouches. Moreover, similar to the shape illustrated in FIG. 7, an inwardly recessed shape (for example, an arc shape) may be provided instead of the shape in which both of the lower ends of the inner space are formed in an inclined linear shape.

Furthermore, for example, as a second pouch 131E of a second inner container 13E illustrated in FIG. 8C, a shape in which the upper portion of the inner space is gradually narrowed upward and the lower portion is gradually narrowed downward may be provided. Thus, the same effect (effect that the content is unlikely to remain in the lower portion) as that of the configuration of FIG. 8B is obtained in addition to the same effect (effect that the content is easily discharged sequentially from the upper side) as that of the embodiment described above. Also, in this case, an inwardly recessed shape (for example, an arc shape) may be provided instead of the shape in which the both upper end portions and the both lower end portions of the inner space are formed in an inclined linear shape.

Figure 9B:
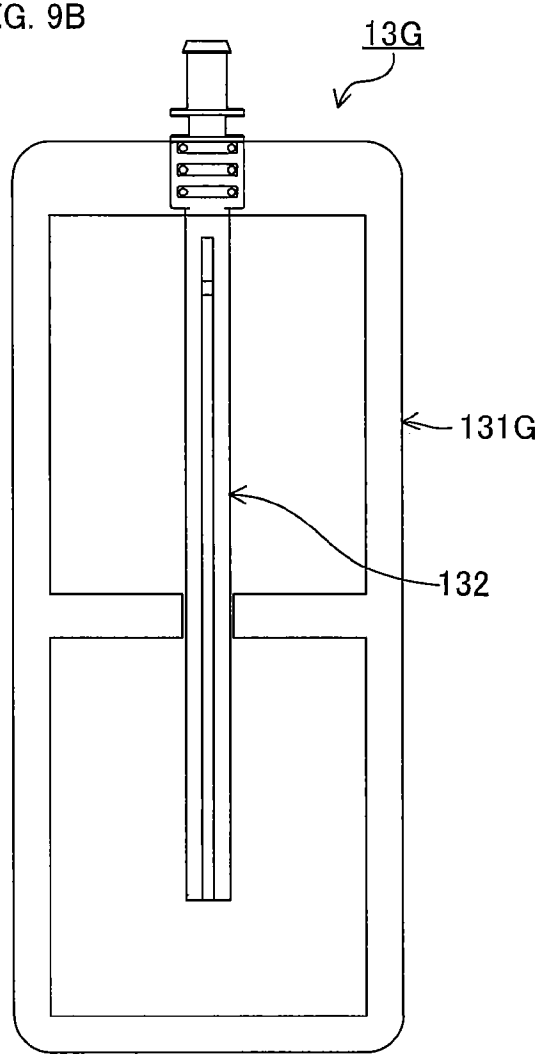
FIG. 9A is an external view of a pouch having a shape in which a lower portion of an inner space is protruded downward in an arc shape and FIG. 9B is an external view of a pouch having a shape in which an inner space is divided into a plurality of chambers.
Figure 9A:
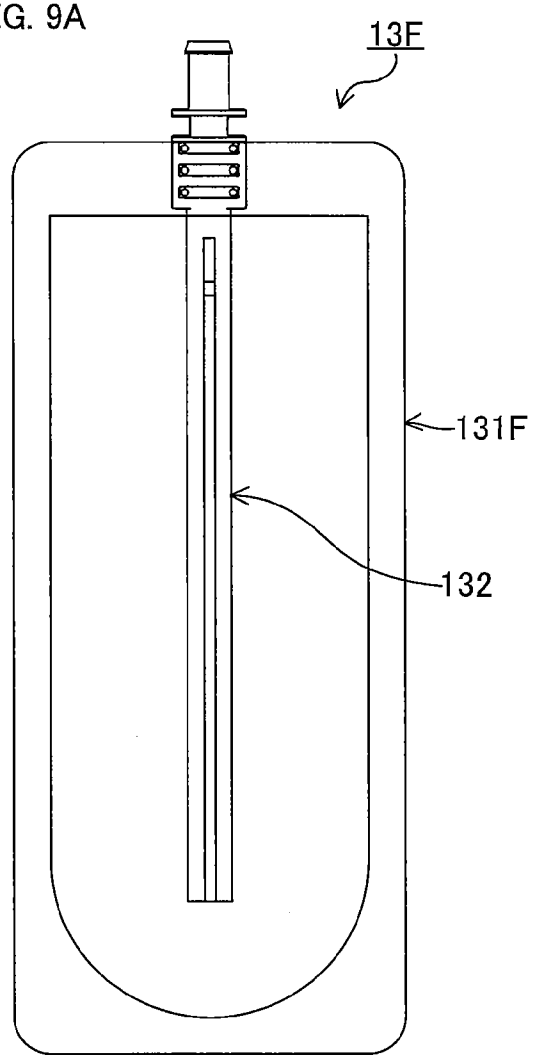

Furthermore, for example, as a second pouch 131F of a second inner container 13F illustrated in FIG. 9A, the lower portion of the inner space may be a shape protruding downward in an arc shape. Even in this case, the same effect (effect that the content is unlikely to remain in the lower portion) as that of the configuration of FIG. 8B is obtained.

Furthermore, for example, as a second pouch 131G of a second inner container 13G illustrated in FIG. 9B, the inner space may be divided into a plurality of chambers (in the example, two up and down chambers). In this case, the discharge amount of the content is easily adjusted for each chamber and it is possible to sequentially discharge from the upper side.

Figure 10C:
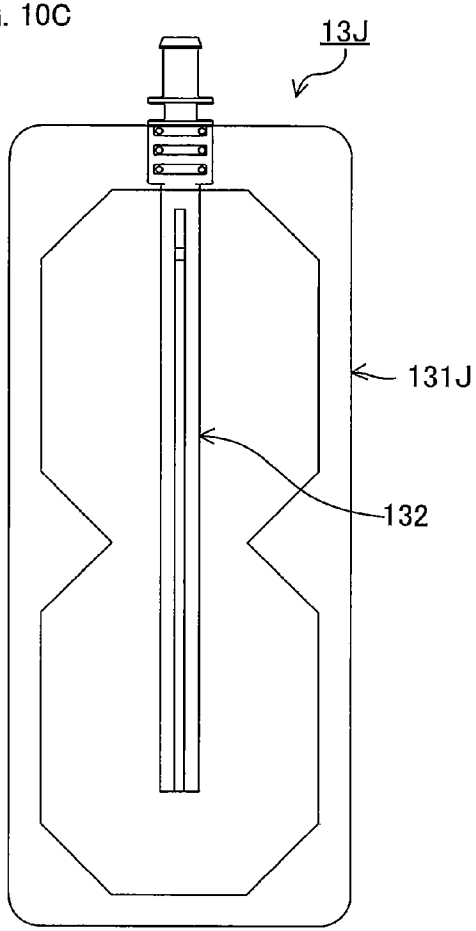
FIG. 10C is an external view of a pouch having constriction of a shape gradually narrowed upward and downward.
Figure 10B:
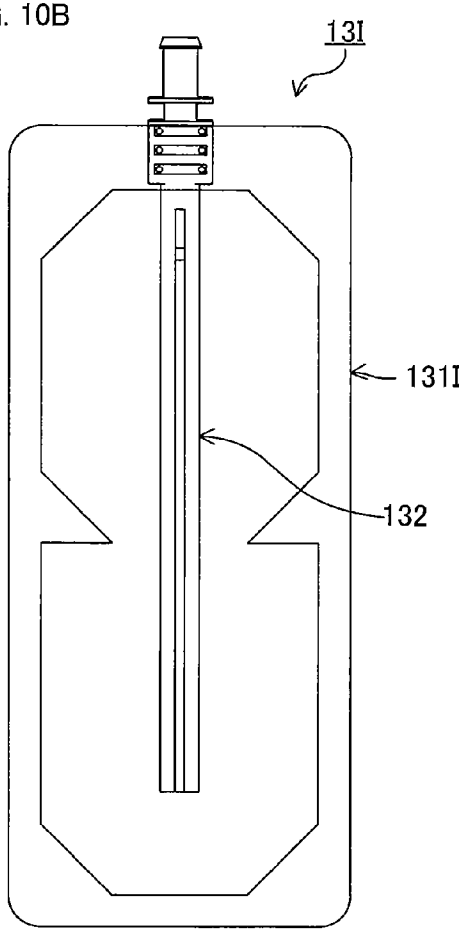
FIG. 10B is an external view of a pouch having constriction of a shape gradually narrowed downward.
Figure 10A:
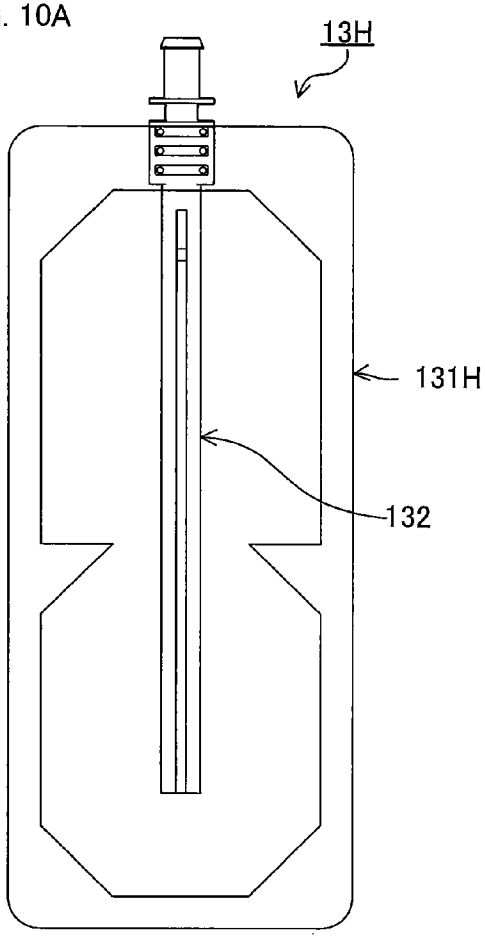
FIG. 10A is an external view of a pouch having constriction of a shape gradually narrowed upward.

Furthermore, for example, as illustrated in FIGS. 10A to 10C, the side portion of the inner space may be a constricted shape. Specifically, for example, as the second pouch 131H of a second inner container 13H illustrated in FIG. 10A, a shape that is gradually narrowed upward may be provided. Furthermore, for example, as a second pouch 131I of a second inner container 13I illustrated in FIG. 10B, a shape that is gradually narrowed downward may be provided. Furthermore, as a second pouch 131J of a second inner container 13J illustrated in FIG. 10C, a shape that is gradually narrowed upward and downward may be provided. Even in this case, the same effect (effect that the content is easily sequentially discharged from the upper side) as that of the configuration of FIG. 9B is obtained. Specifically, a restoring force (force acting for discharging the content) in the upper side is greater than a restoring force in the lower side and the content can be easily sequentially discharged from the upper portion by making the inner space of the upper side be greater than the inner space of the lower side.

Figure 11B:
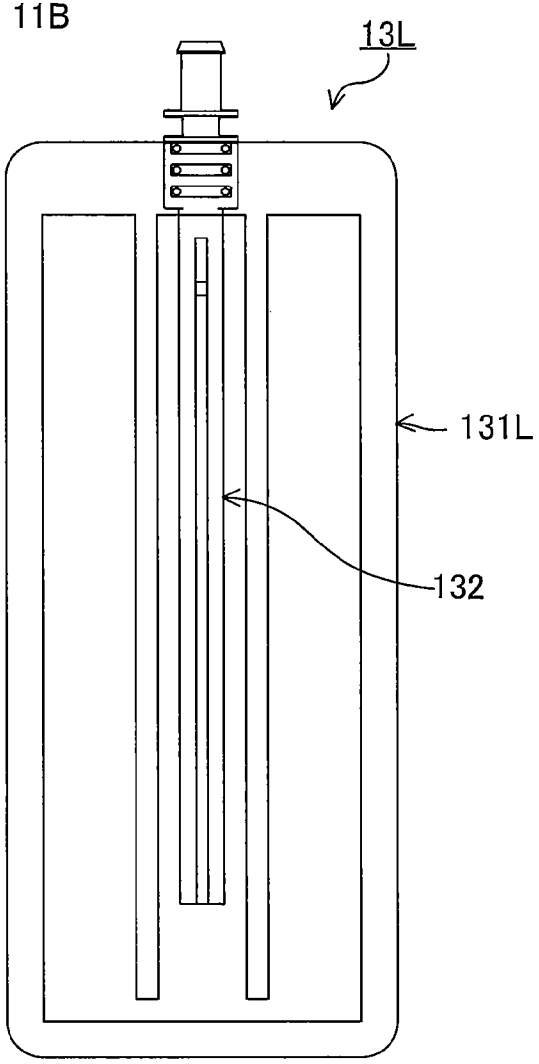
FIG. 11A is an external view of a pouch having a shape in which an inner space is vertically divided into a plurality of chambers and FIG. 11B is an external view of a pouch having a shape in which an inner space is laterally divided into a plurality of chambers.
Figure 11A:
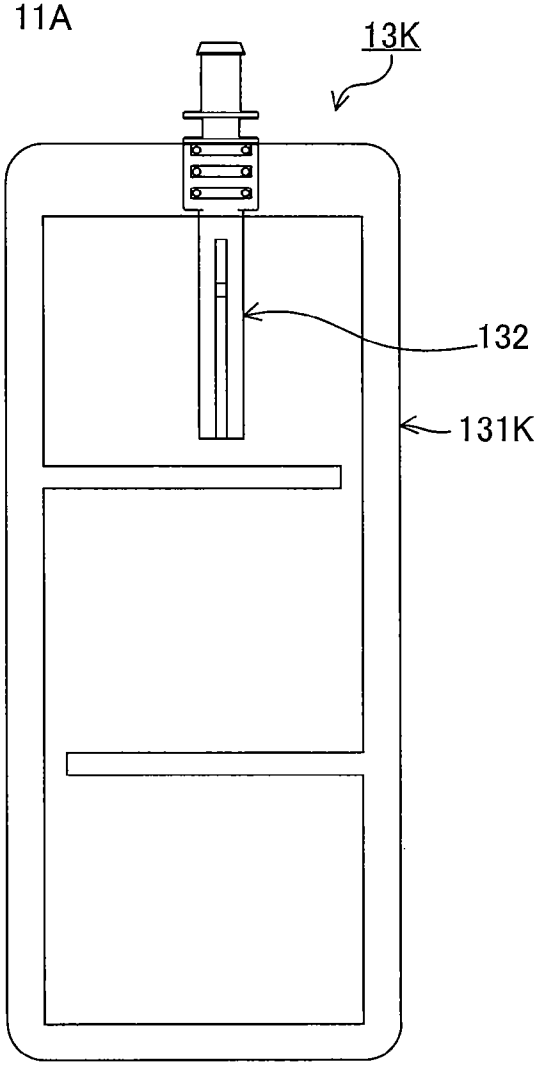

Furthermore, for example, as a second pouch 131K of a second inner container 13K illustrated in FIG. 11A, the inner space is divided into a plurality of chambers (in the example, three up and down chambers) and a shape in which chambers adjacent to each other communicate with each other by one end portion (in the example, side to be alternated between right and left) may be provided. Here, the dividing direction is not limited to up and down, and for example, as a second pouch 131L of a second inner container 13L illustrated in FIG. 11B, the inner space is divided into a plurality of chambers in right and left, and the chambers adjacent to each other may have shapes which communicate with each other by one end portion (in the example, the lower end). In this case, since the flow of the content in the inner space is regulated, deviation of the aspect in which the content is discharged hardly occurs.

Figure 12A:
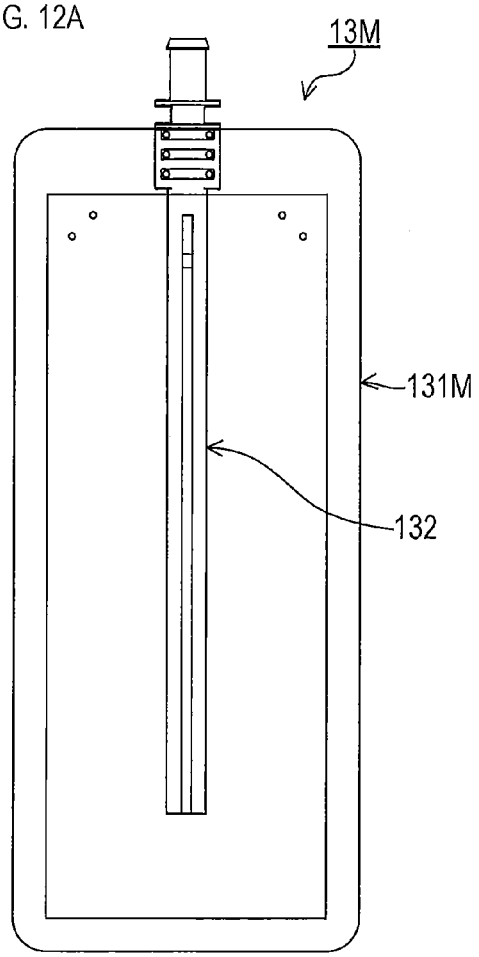
FIG. 12A is an external view of a pouch in which the inside of an inner space is partially welded in a point shape and FIG. 12B is an external view of a pouch in which the inside of an inner space is partially welded in a line shape.
Figure 12B:
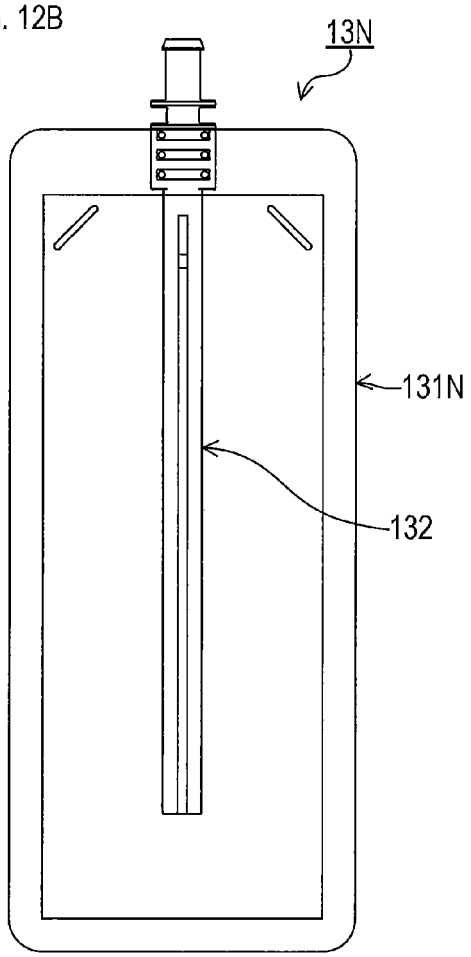

Furthermore, the inside of the inner space may be partially welded. For example, as a second pouch 131M of a second inner container 13M illustrated in FIG. 12A, the inside (in the example, both upper ends) of the rectangular inner space may be partially welded in a point shape. In this case, it is possible to obtain the same effect as that of the shape in which the both upper ends of the inner space are formed to be linearly inclined as in the embodiment described above. In the example, two positions are respectively welded in right and left, but one position is welded in right and left, and more positions may be welded than the example. Furthermore, it is possible to obtain the same effect as that of various shapes described above depending on the welding position. Furthermore, as a second pouch 131N of a second inner container 13N illustrated in FIG. 12B, the inside (in the example, both upper ends) of the rectangular inner space may be partially welded in a linear shape.

Furthermore, the outer shape of the pouch may be changed depending on the shape of the inner space of the pouch. For example, as illustrated in FIG. 8B, if the lower portion of the inner space has the shape gradually narrowed downward, the outer shape of the pouch may also have the shape gradually narrowed downward. In this case, it is possible to hardly interfere with the outer container 11.

Figure 13A:
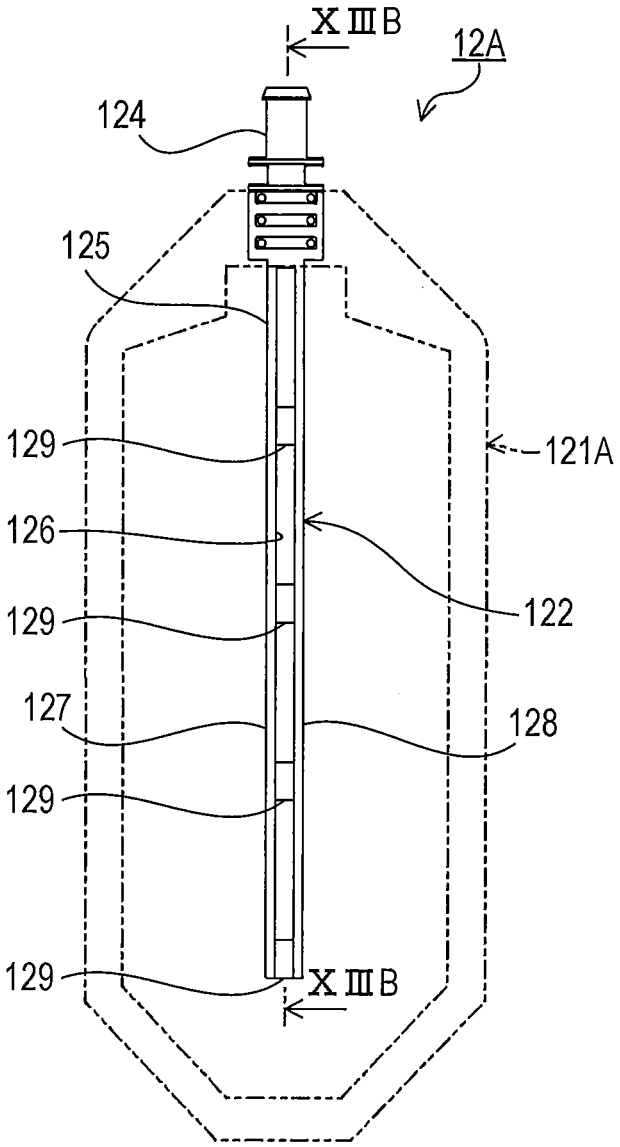
FIG. 13A is an external view of a pouch having a shape in which each of both ends of an upper portion and a lower portion is linearly inclined and FIG. 13B is a cross-sectional view that is taken along line XIIIB-XIIIB of FIG. 13A.
Figure 13B:
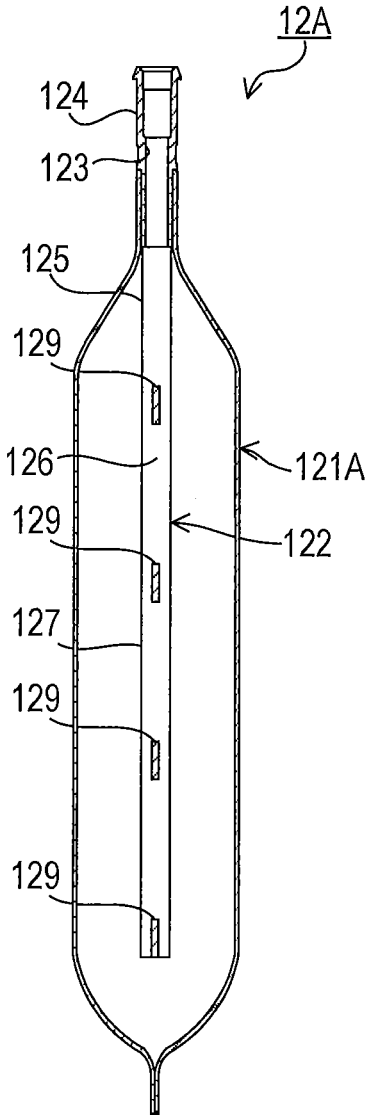

Furthermore, for example, as a first pouch 121A of a first inner container 12A illustrated in FIG. 13A, an outer shape of a shape (shape gradually narrowed upward and downward, and in which four corners of a rectangular shape are cut) in which the both upper ends and the both lower ends are linearly inclined may be provided. In this case, it is possible to suppress twist or inclination of the pouch 121A caused by interference with the inner wall of the outer container 11. Furthermore, as illustrated in FIG. 13A, a width of a seal part (peripheral edge bonding the seal materials each other) of the upper portion in the pouch 121A may be greater (area of the seal part is large) than the width of the seal part of the lower portion. In this case, the seal part of the upper portion is harder than the seal part of the lower portion, and even when inverted falling (falling with the head part 124 being directed downward), the pouch 121A is hardly crushed and it is possible to maintain the same state of the pouch 121A as that before falling thereof. Furthermore, as illustrated in FIG. 13B, it is difficult for the upper portion of the pouch 121A to be widened in the thickness direction (thickness is narrowed) compared to the lower portion of the pouch 121A. Thus, an inner volume in the upper portion of the pouch 121A is smaller than an inner volume in the lower portion of the pouch 121A. As a result, the content is always easily filled in a constant balance (state where the lower side is large). Thus, when using the pouch 121A having such a shape for the first inner container and the second inner container, deviation of the discharging ratio of the first inner container and the second inner container can hardly occur.

(4) Shape of Flow Passage Member

Figure 14A:
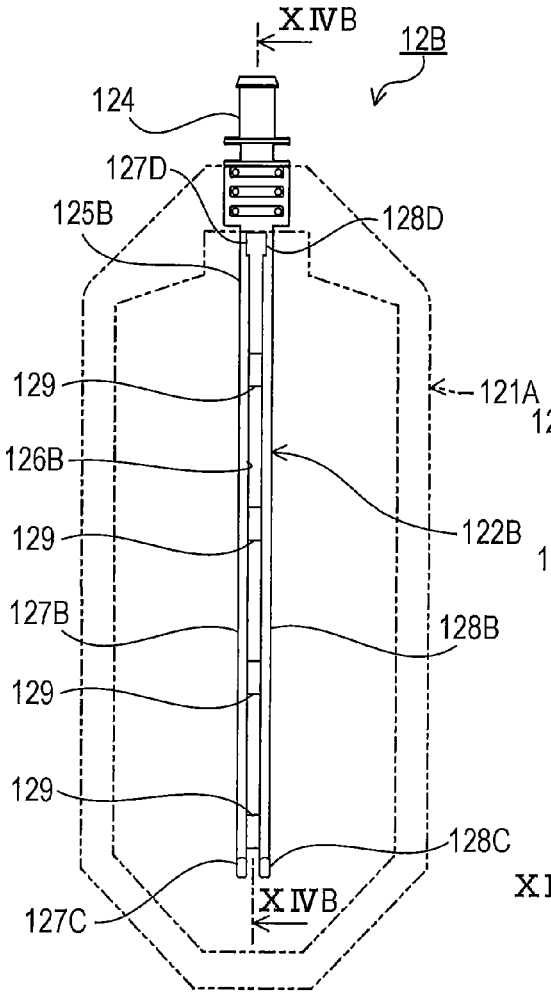
FIG. 14A is an external view of a first inner container having a joint member of a modified example.
Figure 14B:
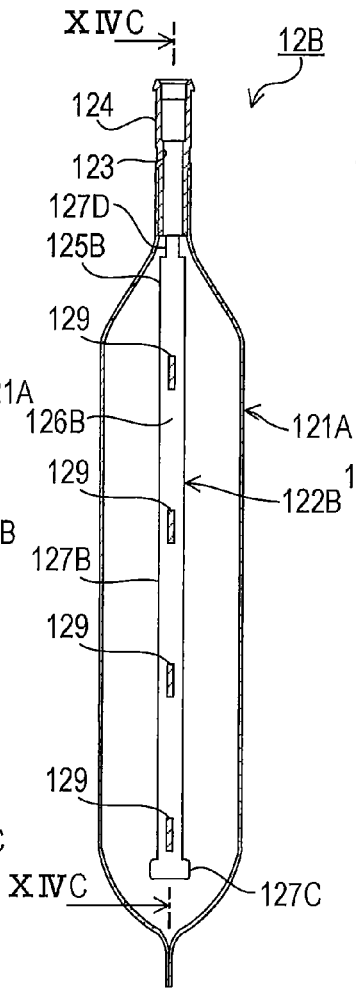
FIG. 14B is a cross-sectional view that is taken along line XIVB-XIVB of FIG. 14A.
Figure 14C:
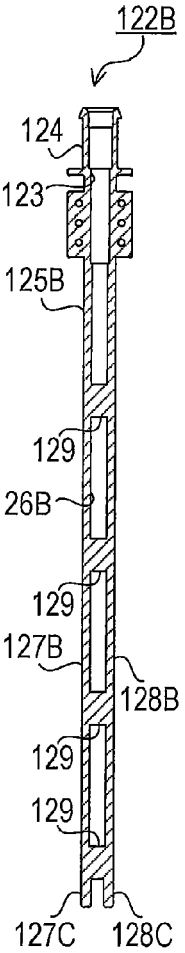
FIG. 14C is a cross-sectional view that is taken along line XIVC-XIVC of FIG. 14B.
Figure 14D:
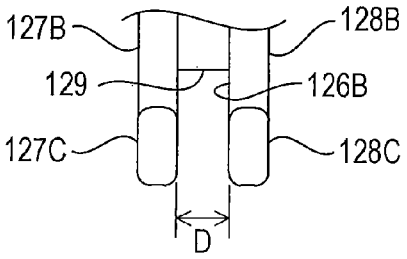
FIG. 14D is an enlarged view of a lower end portion of a rod-shaped part viewed from the same direction as that of FIG. 14A.
Figure 14E:
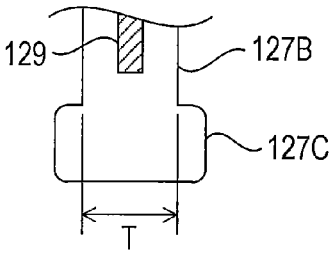
FIG. 14E is an enlarged view of a lower end portion of a rod-shaped part viewed from the same direction as that of FIG. 14B.

In the embodiment described above, as the flow passage member, the first joint member 122 and the second joint member 132 are exemplified, but the shape of the flow passage member is not limited to the embodiment. For example, a joint member 122B of a first inner container 12B illustrated in FIGS. 14A to 14C has basically the same shape as that of the first joint member 122 of the embodiment described above. However, in the joint member 122B, a thickness dimension (length of the width in a direction orthogonal to the surface of the pouch 121 and a lateral direction in FIG. 14B) of the lower end portion in a rod-shaped part 125B is formed longer than that of a portion other than the lower end portion. Specifically, as illustrated in FIG. 14D, protrusion parts 127C and 128C protruding further downward than the connecting part 129 of the lowermost end are formed in the lower end of rods 127B and 128B. The protrusion parts. 127C and 128C have the same shape and as illustrated in FIG. 14E, protrude on both sides (both right and left sides in the lateral direction in FIGS. 14B and 14E) in the thickness direction compared to a portion other than the protrusion parts 127C and 128C in the rods 127B and 128B. In such a shape, it is possible to hardly close the pouch 121 in the lower end portion of the rod-shaped part 125B and to easily pump out the content accumulated in the lower portion in the inner space of the pouch 121.

Figure 14F:
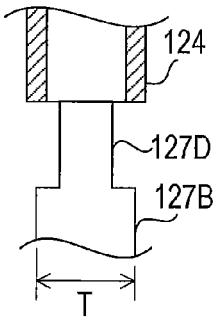
FIG. 14F is an enlarged view of an upper end portion of a rod-shaped part viewed from the same direction as that of FIG. 14B.

Furthermore, in the joint member 122B, a thickness dimension of the upper end portion (connection part to the head part 124 and a portion positioned in the uppermost portion in the inner space of the pouch 121) in the rod-shaped part 125B is formed to be shorter than that of a portion other than the upper end portion. Specifically, upper end portions 127D and 128D of the rods 127B and 128B have the same shape as each other and, as illustrated in FIG. 14F, are further inwardly (center line side) recessed in both end sides in the thickness direction than a portion other than the upper end portions 127D and 128D in the rods 127B and 128B. In such a shape, since a groove is formed in the upper end portion of the rod-shaped part 125, the content accumulated in the side of the rod-shaped part 125 easily flows between the rods 127B and 128B from the groove. Thus, it is possible to reduce the remaining amount of the content. Specifically, since the groove is formed in the upper end portion, it is possible to reduce the remaining amount of the content between the rods 127B and 128B further than in a configuration in which the groove is formed in the portion other than the upper end portion.

Figure 15C:
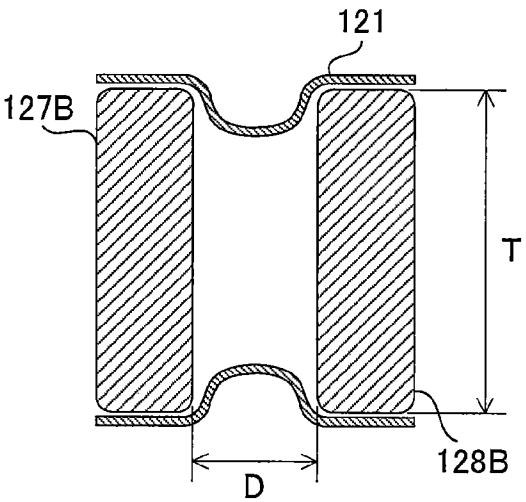
FIG. 15C is a cross-sectional view of the first inner container in a case where the ratio T/D is greater than 3.0.
Figure 15B:
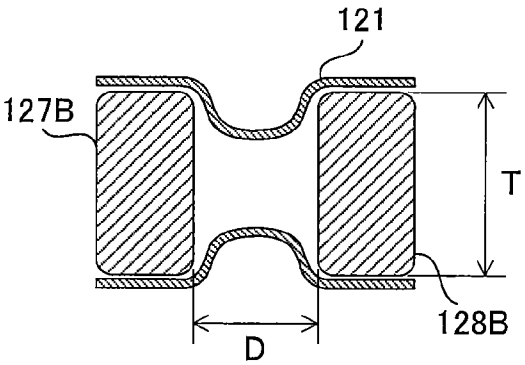
FIG. 15B is a cross-sectional view of the first inner container in a case where the ratio T/D is 1.0 to 3.0.
Figure 15A:
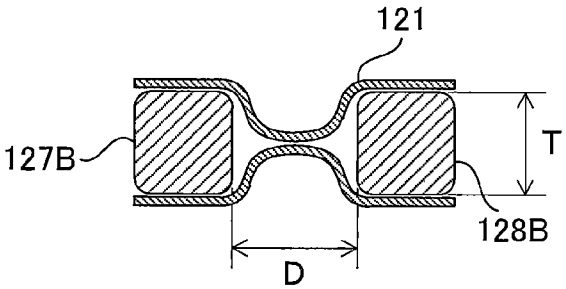
FIG. 15A is a cross-sectional view of the first inner container in a case where a ratio T/D is less than 1.0.

A thickness T of a portion other than the protrusion parts 127C and 128C, and the upper end portions 127D and 128B in the rods 127B and 128B is constant (see FIGS. 14E and 14F). Furthermore, a gap (lateral width dimension of a slit 126B) D between the rods 127B and 128B is also constant (see FIG. 14D). If the thickness of the pouch 121 is in a range of 70 μm to 150 μm, a ratio T/D between the thickness T of the rods 127B and 128B and the gap D may be 1.0 to 3.0. As illustrated in FIG. 15A, if the ratio T/D is less than 1.0, the pouch 121 is easily closed and the content is hardly discharged. Furthermore, as illustrated in FIG. 15C, the ratio T/D is greater than 3.0 and the pouch 121 is hardly closed, but the amount of the content remaining between the rods 127B and 128B is increased. In contrast, if the ratio T/D is 1.0 to 3.0, as illustrated in FIG. 15B, it is possible to reduce the amount of the content remaining between the rods 127B and 128B while preventing the blocking of the pouch 121.

FIG. 16 illustrates test results in cases where the thickness T of the rods 127B and 128B and the gap D are different. In the test, 40 g of the first agent was filled in the first pouch 121 having the thickness of 121 μm and 40 g of the second agent was filled in the second pouch 131 having the thickness of 104 μm. Then, a case where 30 g or more of 40 g of the content can be discharged with discharge amount of 2 g to 15 g or more for every three seconds was evaluated as good and a case where the discharge amount cannot be discharged was evaluated as permissible. As illustrated in FIG. 16, in a case where the ratio T/D is 1.0 to 3.0, a good result was obtained and, specifically, in a case where the ratio T/D is 1.2 to 2.2, a better result was obtained. Moreover, in the joint member 122B illustrated in FIGS. 14A to 14C, the thickness T of the portion other than the protrusion parts 127C and 128C and the upper end portions 127D and 128D is constant in the rods 127B and 128B, and the gap D between the rods 127B and 128B is also constant. Thus, since the effect described above is obtained in most portions in the rod-shaped part 125B by designing the ratio T/D of the portion to be in a range of 1.0 to 3.0, a high effect can be obtained as a result. However, the shape of the joint member is not specifically limited and the effect described above can be obtained in the portion as long as the portion in which the ratio T/D is in the range of 1.0 to 3.0 also partially exists and, specifically, the effect can be increased as the ratio of the portion is increased.

Moreover, the shape illustrated in FIGS. 14A to 14F may be applied to one of the first joint member and the second joint member or may be applied to both sides. Furthermore, as a pouch, the pouch 121 of the embodiment described above is exemplified, but is merely an example, and is not limited to the embodiment.

Furthermore, for example, the position or the number of the slits may be changed. Specifically, the slits may be formed on both surfaces of the rod-shaped part (for example, H type cross section) and the slits may be formed in a corner part of the rod-shaped part (for example, T-shaped cross section, cross-shaped cross section, and star-shaped cross section). Furthermore, the slit may be formed around the rod-shaped part in a spiral shape.

Furthermore, the flow passage member is not limited to the configuration in which the opening flow passage is formed by the slit and may be a configuration (tube) having an inner flow passage. In this case, furthermore, a hole may be formed in the upper portion so that the content is preferentially discharged from the upper portion rather than the lower portion of the inner space. For example, if a plurality of holes are formed, intervals of the holes may be decreased as the holes are made in the upper portion or the size of the holes may be increased as the holes are made in the upper portion. Furthermore, as illustrated in FIGS. 10A to 10C described above, in the shape having the constriction, since the content easily remains in the upper portion of the constriction, the hole may be formed in a position corresponding to the upper portion of the constriction. Furthermore, the same effect is obtained by widening the width dimension of the slit or by deepening the depth of the slit instead of the hole of the tube.

Furthermore, the length of the flow passage member may be a length that makes a gap with a bottom side of the pouch become as small as possible. Furthermore, the flow passage member having the same configuration may be used in a plurality of pouches. Furthermore, the flow passage member may not be used in at least a part of the plurality of pouches.

(5) Other Modified Examples

The pouch is not limited to the configuration in which the entire periphery thereof is sealed and, for example, one sheet is folded, and three sides of the sheet may be sealed. Furthermore, for example, the pouch may be a gusset type having a "gusset" in the side portion and the like.

The content is not limited to the first agent and the second agent of the two-agent type hair dye, decoloring agent, or dye remover, and, for example, may be a hair dye, a treatment agent, and the like. Moreover, the hair dye includes acidic hair dye, direct hair dye, a temporal coloring agent, and the like.

Furthermore, the number of the inner containers is not limited to two and may be three or more. For example, three-type hair treatment compositions configuring three agent-type hair dye, decoloring agent, or dye remover are separately stored and may be discharged by combining them. Furthermore, one inner container is formed and the hair treatment composition (for example, one agent-type medicine) used as it is without being mixed may be stored.

Figure 17:
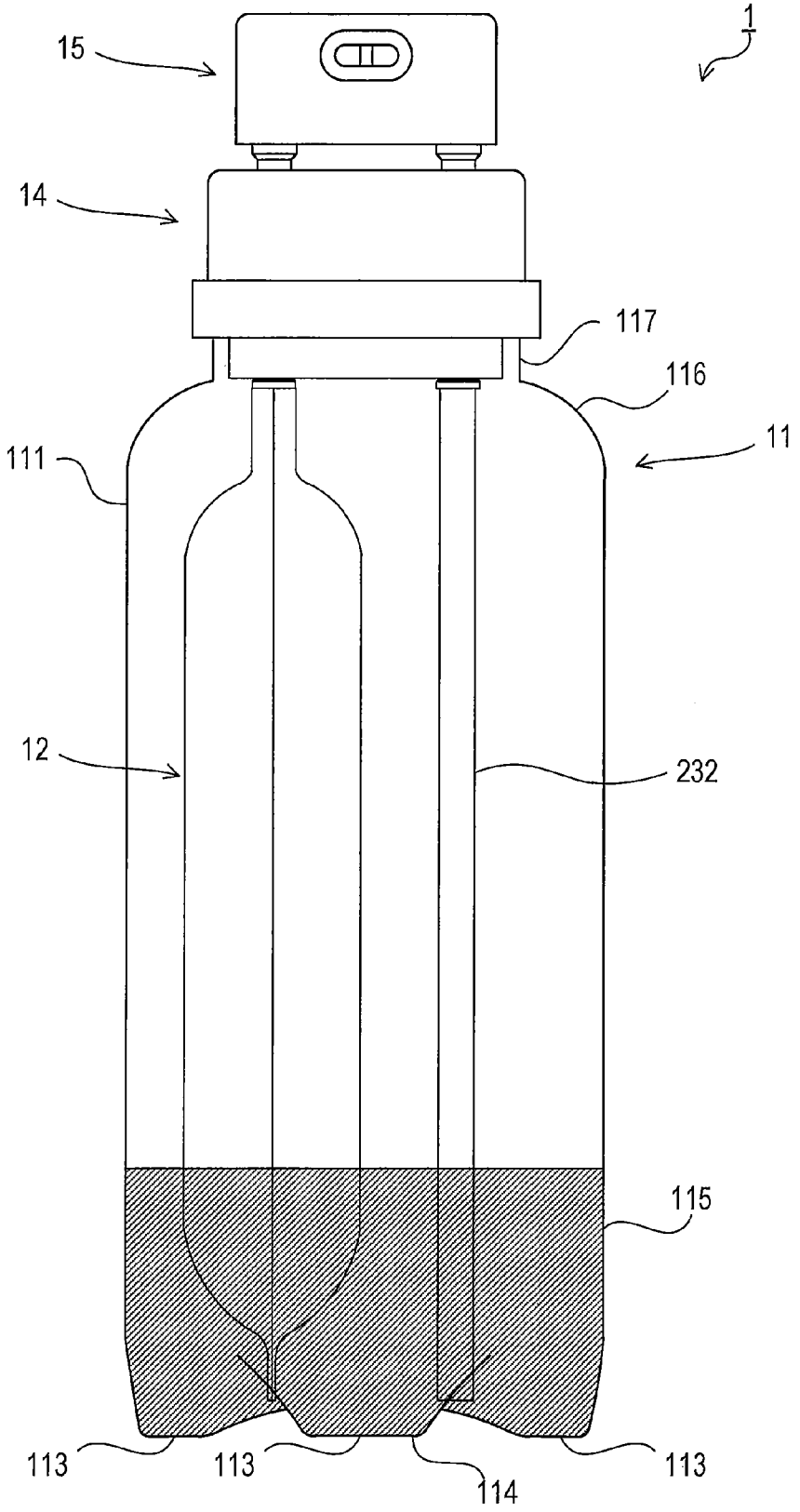
FIG. 17 is an external view of a double-aerosol device having a configuration in which one of a plurality of contents is directly stored in the outer container.

Furthermore, as illustrated in FIG. 17, one (in the embodiment described above, for example, the second inner container) among a plurality of contents is directly stored in the outer container 11 without storing in the pouch and may be sucked by a tube 232. In this case, the propellant is filled in a remaining space in the outer container 11. In this case, since a liquid surface of the content directly stored in the outer container 11 can be visually recognized from the outside of the outer container 11, it is possible to relatively accurately grasp the remaining amount of the content.

Figure 18:
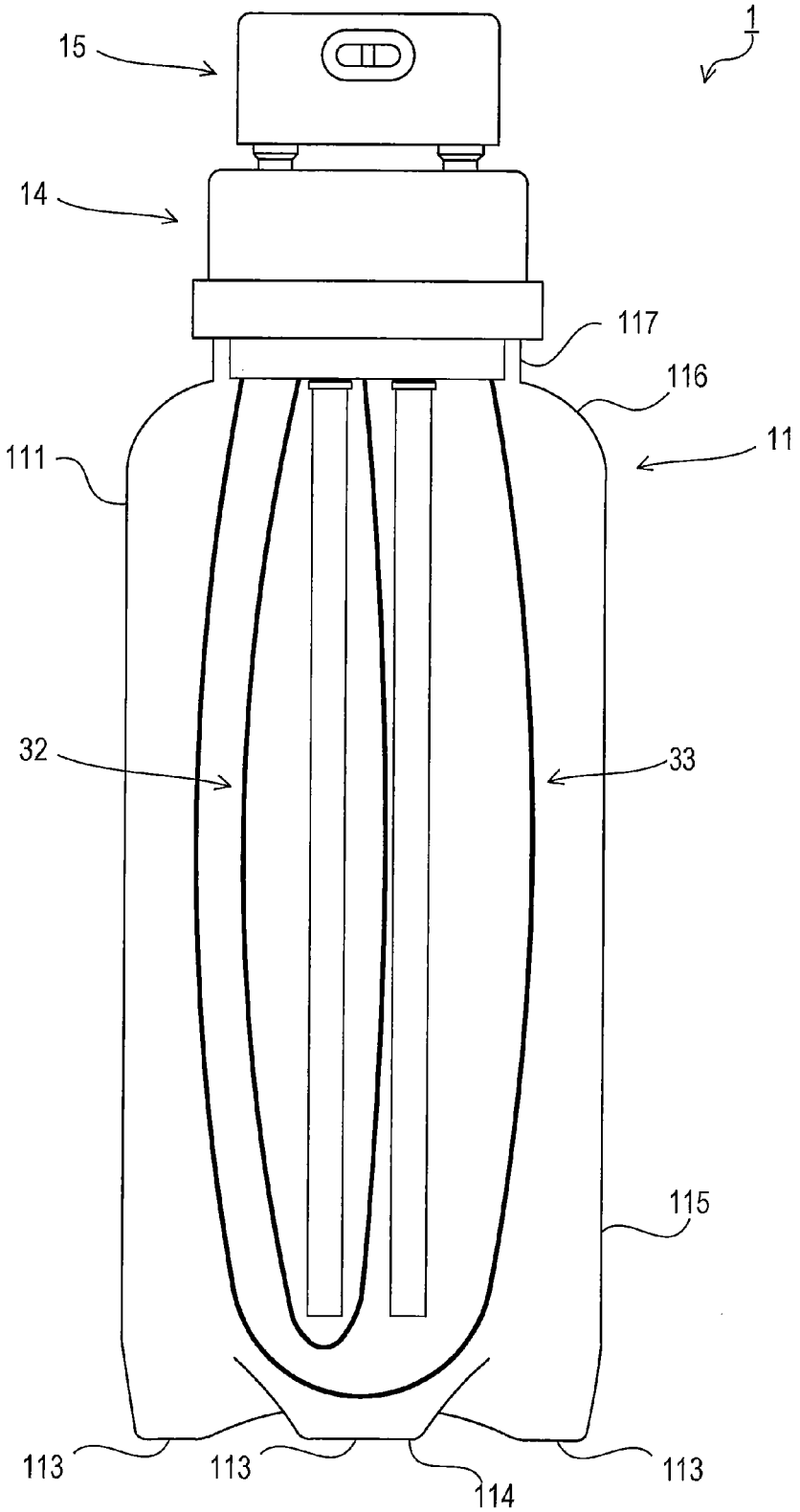
FIG. 18 is an external view of a double-aerosol device having a configuration in which one pouch is stored in the other pouch.

Furthermore, as illustrated in FIG. 18, a configuration in which one inner container 32 is stored in the other inner container 33 may be provided. In this case, since the inner container 33 of the outside is visually recognized but the inner container 32 of the inside is not visually recognized, it is possible to grasp the remaining amount of the content based on a degree of deformation of one inner container 33. Moreover, at least a part of the inner container 33 of the outside is transparent and the inside thereof can be also visually recognized.

Furthermore, as described above, it is possible to stabilize the discharge amount of the content and to easily discharge the content even if the remaining amount is small by making the thickness of the inner container (pouch) be in an appropriate range. Test results of the discharge amount in a case where a pouch having a multi-layered structure formed of PET/AL/EMAA (copolymer of ethylene and methacrylic acid)/special PE in an order from an outer layer are illustrated in FIG. 19. In the test, a case where the discharging of the content inside the pouch was completed within a first time was evaluated as good, a case where the discharging of the content was completed within a second time which is longer than the first time was evaluated as permissible, and a case where the discharging of the content was not completed within the second time was evaluated as bad. As illustrated in FIG. 19, the content could be discharged in the thickness range of 70 μm to 150 μm described above without a problem; specifically, a good result was obtained in a range of 100 μm to 150 μm, and a further good result was obtained in a range of 100 μm to 130 μm.

The invention claimed is:

1. A double-aerosol device comprising:

a plurality of inner containers that separately store a plurality of types of hair treatment compositions used by mixing as a hair dye, decoloring agent, or dye remover; and an outer container in which the plurality of inner containers are stored, wherein the hair treatment compositions are discharged to the outside by contracting the plurality of inner containers by a pressure of propellant, wherein the outer container is configured such that at least a part of the inside of the outer container is visible so as to confirm remaining amounts of the hair treatment compositions, wherein each of the plurality of inner containers comprises a pouch that stores the hair treatment compositions, and a flow passage member that is fixed to a communication port of the pouch and has a rod-shaped part inserted into the pouch, and wherein the rod-shaped part of at least one of the plurality of inner containers comprises a protrusion part formed on a lower end portion thereof, the protrusion part having a thickness dimension, which is a length of the width in a direction that is orthogonal to a surface of the pouch, formed longer than a thickness dimension of a portion other than the lower end portion.

2. The double-aerosol device according to claim 1, wherein an upper portion of an inner space of at least one of the plurality of inner containers has a shape narrowing upward.

3. The double-aerosol device according to claim 1, wherein the pouch of at least one of the plurality of the inner containers comprises a transparent portion and is configured so that an inside portion of the pouch is visually recognized.

4. The double-aerosol device according to claim 3, wherein the plurality of inner containers comprises a first inner container storing a first agent containing an alkaline agent, and a second inner container storing a second agent containing hydrogen peroxide, wherein an opaque sheet material is used for a first pouch in the first inner container, and wherein a transparent sheet material is used for a second pouch in the second inner container.

5. The double-aerosol device according to claim 1, wherein the plurality of inner containers comprises a first inner container and a second inner container, wherein the first inner container and the second inner container are stored in the outer container in parallel, wherein the second inner container comprises the pouch having a transparent portion and is configured so that at least one portion of an outwardly facing surface of the rod-shaped part that is inserted into the pouch is visually recognized, and wherein the outwardly facing surface is a surface opposite to an inwardly facing surface of the rod-shaped part facing a side of the first inner container.

6. The double-aerosol device according to claim 5, wherein the flow passage member disposed in the second inner container comprises a slit formed on the inwardly facing surface, and wherein the outwardly facing surface is devoid of a slit.

7. The double-aerosol device according to claim 1, wherein the rod-shaped part having the protrusion part formed thereon has a shape comprising two rods arranged parallel with a gap therebetween, and a plurality of connecting parts that connect the two rods, and wherein the plurality of connecting parts are provided in a plurality of locations having an interval between each other.

8. The double-aerosol device according to claim 7, wherein a portion having the thickness dimension of a constant thickness is formed on the rod-shaped part other than on the protrusion part formed thereon, and wherein a ratio between the constant thickness and a gap thickness associated with the gap between the two rods is 1.0 to 3.0.

9. The double-aerosol device according to claim 1, wherein the pouch of at least one of the plurality of the inner containers comprises a transparent portion and is configured so that an inside of the pouch can be visually recognized, and wherein both a right and a left side of the pouch are opaque.

10. The double-aerosol device according to claim 1, wherein the plurality of the inner containers comprises a first inner container and a second inner container, wherein the pouch disposed in the second inner container and comprises a transparent portion, the pouch being configured so that the rod-shaped part inserted in the pouch can be visually recognized, and wherein a lateral width of the rod-shaped part of the flow passage member of the second inner container is greater than a lateral width of the rod-shaped part of the flow passage member disposed in the first inner container.

* * * * *